US008613522B2

(12) United States Patent
Kang et al.

(10) Patent No.: US 8,613,522 B2
(45) Date of Patent: Dec. 24, 2013

(54) POWER SUPPLYING MODULE AND BACKLIGHT ASSEMBLY

(75) Inventors: Won-Hyoung Kang, Asan-si (KR); Min-Gyu Kim, Asan-si (KR); Jae-Eun Um, Cheonan-si (KR); Kyun-ho Kim, Daejeon (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 243 days.

(21) Appl. No.: 13/197,992

(22) Filed: Aug. 4, 2011

(65) Prior Publication Data

US 2012/0206903 A1 Aug. 16, 2012

(30) Foreign Application Priority Data

Feb. 11, 2011 (KR) ..... 10-2011-0012441

(51) Int. Cl.
*F21V 33/00* (2006.01)

(52) U.S. Cl.
USPC ..... 362/97.1; 362/225; 439/620.25

(58) Field of Classification Search
USPC ..... 362/630, 631, 260, 97.1, 225; 439/620.24, 620.25
See application file for complete search history.

(56) References Cited

U.S. PATENT DOCUMENTS

| | | | | |
|---|---|---|---|---|
| 7,651,354 | B2 * | 1/2010 | Kim | 439/226 |
| 2008/0079862 | A1 * | 4/2008 | Lee | 349/58 |
| 2009/0046462 | A1 * | 2/2009 | Park et al. | 362/249 |
| 2009/0279281 | A1 * | 11/2009 | Chung et al. | 362/97.1 |
| 2010/0002419 | A1 * | 1/2010 | Naito | 362/97.1 |
| 2010/0073908 | A1 * | 3/2010 | Bae | 362/97.1 |
| 2010/0157194 | A1 * | 6/2010 | Kim | 349/61 |
| 2010/0195312 | A1 * | 8/2010 | Ko et al. | 362/97.1 |

FOREIGN PATENT DOCUMENTS

| | | |
|---|---|---|
| KR | 1020060017105 | 2/2006 |
| KR | 1020080008570 | 1/2008 |
| KR | 1020090102141 | 9/2009 |

* cited by examiner

*Primary Examiner* — Laura Tso
(74) *Attorney, Agent, or Firm* — F. Chau & Associates, LLC

(57) ABSTRACT

A power supplying module includes a printed circuit board (PCB), a transformer, a circuit pattern, and an output terminal. The PCB includes a first socket connector protruded from a side toward a second direction. The side extends along a first direction different from the second direction. At least one corner portion of the first socket connector includes a chamfered edge connecting first and second edges respectively extending in the first and second directions. The transformer is formed on the PCB. The circuit pattern is formed on the PCB and connected to the transformer. The output terminal is formed at the first socket connector and connected to the circuit pattern.

19 Claims, 12 Drawing Sheets

POWER SUPPLYING MODULE AND BACKLIGHT ASSEMBLY

CROSS-REFERENCE TO RELATED APPLICATION

This application claims priority under 35 U.S.C. §119 to Korean Patent Application No. 2011-12441, filed on Feb. 11, 2011, in the Korean Intellectual Property Office (KIPO), the contents of which are herein incorporated by reference in their entireties.

BACKGROUND OF THE INVENTION

1. Technical Field

Example embodiments of the present invention relate to a power supplying module and a backlight assembly. More particularly, example embodiments of the present invention relate to a power supplying module and a backlight assembly for a liquid crystal display apparatus.

2. Discussion of the Related Art

A liquid crystal display (LCD) apparatus may include an LCD panel, a driving part driving the LCD panel and a backlight assembly providing light to the LCD panel. Transmittance of the light from the backlight assembly is controlled by applying a voltage to a liquid crystal layer, and thus an image may be displayed.

A backlight assembly may include a light source emitting the light, a socket electrically connected to the light source, a receiving container receiving the light source, and a power supplying module, for example an inverter, electrically connected to the socket and applying a driving voltage to the light source. The power supplying module may include a transformer mounted on a printed circuit board, a circuit pattern such as a capacitor, and an output terminal electrically connected to the circuit pattern for connecting to the socket. In a direct-illumination type backlight assembly, the light source includes a plurality of lamps, and the printed circuit board of the power supplying module may extend along a direction substantially perpendicular to an extending direction of the lamps, for example, in an arrangement direction of the lamps, and is connected to an end portion of each of the lamps. The power supplying module may face an outer surface of the receiving container.

According to a process for combining a power supplying module with an outer surface of the receiving container, a worker holds both ends of the power supplying module and slides the power supplying module onto the outer surface of the receiving container. The power supplying module may be partially inserted into the socket. In addition, a worker may hold the power supplying module to detach the power supplying module from the socket.

However, when detaching the power supplying module from the socket, the power supplying module may be cracked or partially damaged due to non-uniform forces applied to one or both ends of the power supplying module by the worker. The crack in the power supplying module may not be visible to a worker so that the power supplying module having the crack may be used to the final product. In addition, when the power supplying module having the crack is driven for a long time, an accidental fire may occur due to the driving voltage for the light source.

SUMMARY OF THE INVENTION

Example embodiments of the present invention provide a power supplying module which permits safe combining and detaching of a lamp socket with a printed circuit board (PCB), without causing damage to the power supplying module.

Example embodiments of the present invention also provide a backlight assembly which permits safe combining and detaching of the lamp socket with the PCB, without causing damage to the power supplying module.

According to an example embodiment of the present invention, a power supplying module includes a PCB, a transformer, a circuit pattern, and an output terminal. The PCB includes a first socket connector protruded from a side of the PCB toward a second direction.

The side extends along a first direction different from the second direction. The first socket connector comprises a first edge portion extending along the first direction, and a second edge portion extending along the second direction, and at least one corner of the first socket connector has a chamfered edge connecting the first and second edge portions. The transformer is formed on the PCB. The circuit pattern is formed on the PCB and connected to the transformer. The output terminal is formed at the first socket connector and connected to the circuit pattern.

In an example embodiment, the PCB may further include a second socket connector. At least one corner of the second socket connector may have a chamfered edge connecting two edges extending in different directions. The first and second socket connectors may be respectively disposed at opposite end portions of the side of the PCB.

In an example embodiment, each of the first and second socket connectors may include a first corner portion and a second corner portion adjacent to the first corner portion along the first direction. Each of the first and second corner portions of the first socket connector and each of the first and second corner portions of the second socket connector may have a chamfered edge connecting two edges extending in different directions.

In an example embodiment, the PCB may further include a plurality of third socket connectors disposed between the first and second socket connectors. The third socket connectors may be protruded toward the second direction. The third socket connectors may be inserted into a lamp socket. Each of leading corner portions of the third socket connectors may have a rounded portion having a predetermined curvature.

In an example embodiment, the PCB may further include a plurality of third socket connectors and a plurality of dummy protrusions. The plurality of third socket connectors may be disposed in a line along the first direction, protruded toward the second direction, and inserted into a lamp socket. The dummy protrusions may be disposed between the third socket connectors, be spaced apart from each other along the first direction, be protruded toward the second direction, and face an outside of the lamp socket.

In an example embodiment, the PCB may have a guide groove having a first opening and a second opening disposed adjacent to the first opening along a direction opposite to the second direction. The first opening may have a first opening width in the first direction. The second opening may have a second opening width in the second direction. The first opening width may be larger than the second opening width.

According to an example embodiment of the present invention, a backlight assembly includes a plurality of lamps, a plurality of lamp sockets and a power supplying module. The lamps emit light and are disposed along a first direction. The lamp sockets are respectively connected to the lamps. The power supplying module includes a PCB. The PCB includes first and second socket connectors protruded from a side toward a second direction. The side extends along a first direction different from the second direction. The first and second socket connectors are respectively disposed at opposing end portions of the side of the power supplying module. Each of the first and second socket connectors are inserted into a lamp socket. Each of the first and second socket connectors has at least one chamfered edge connecting two edges extending in respective first and second directions.

In an example embodiment, the PCB may further include a plurality of third socket connectors. The third socket connectors may be disposed between the first and second socket connectors. The third socket connectors may be protruded toward the second direction to be inserted into a lamp socket. Leading corner portions of the third socket connectors may have a rounded portion having a predetermined curvature. The PCB may further include a dummy protrusion protruded toward the second direction.

In an example embodiment, the PCB may further include a guide groove having a first opening and a second opening adjacent to the first opening along a direction opposite to the second direction. The first opening may have a first opening width in the first direction. The second opening may have a second opening width in the second direction. The first opening width may be larger than the second opening width.

In an example embodiment, the guide protrusion may include an insert potion and a fixing portion. The insert potion may be extended from the bottom plate, and have a first width in the first direction. The fixing portion may be extended from and disposed on the insert potion, and have a second width in the first direction. The second width may be larger than the first width and the second opening width.

According to an example embodiment of the present invention, a backlight assembly includes a plurality of lamps, a PCB and a plurality of lamp sockets. The output terminals are disposed at the straight edge and along an arrangement direction of the lamps. The lamp sockets respectively make contact with the output terminals to connect the lamps to the PCB. Each of the lamp sockets includes a socket housing having a clip portion partially enclosing the straight edge of the PCB.

According to an example embodiment of the present invention, a backlight assembly includes a plurality of lamps, a receiving container, a plurality of lamp sockets and a power supplying module. The lamps emit light and are arranged along a first direction. The receiving container has a bottom plate and sidewalls to form a receiving space in which the lamps are received. A guide protrusion extends from the bottom plate toward an outside of the bottom plate. The lamp sockets are combined with the receiving container and respectively connected to the lamps. Each of the lamp sockets includes a substrate inserting portion protruded outside of the receiving container. The power supplying module includes a PCB. The PCB includes socket connectors and a guide groove in which the guide protrusion is inserted. The socket connectors are arranged along the first direction on an outside of the bottom plate and are protruded toward a second direction different from the first direction to be inserted into the substrate inserting portion of each of the lamp sockets.

A printed circuit board (PCB) for a display apparatus, according to an embodiment of the present invention, comprises a first socket connector located at a first end of and protruding from a side of the PCB toward a second direction, the side of the PCB extending along a first direction perpendicular to the second direction, the first socket connector comprising a first edge portion extending along the first direction, and a second edge portion extending along the second direction, and at least one corner of the first socket connector having a first chamfered edge connecting the first and second edge portions, a second socket connector located at a second end opposite the first end in the first direction and protruding from the side of the PCB toward the second direction, the second socket connector comprising a third edge portion extending along the first direction, and a fourth edge portion extending along the second direction, and at least one corner of the second socket connector having a second chamfered edge connecting the third and fourth edge portions, and a plurality of third socket connectors disposed between the first and second socket connectors and protruded toward the second direction, wherein each of leading corner portions of the third socket connectors has a rounded portion having a predetermined curvature.

The printed circuit board may further comprise a plurality of first dummy protrusions disposed between the third socket connectors, spaced apart from each other along the first direction, and protruded toward the second direction, and a plurality of second dummy protrusions disposed adjacent outside edges of the first and second socket connectors.

According to the power supplying module and the backlight assembly of the embodiments of the present invention, a PCB of a power supplying module may be safely combined with lamp sockets and safely detached from the lamp sockets. Thus, damage to the PCB may be minimized or prevented, and reliability of a display apparatus having the power supplying module and the backlight assembly may be improved.

BRIEF DESCRIPTION OF THE DRAWINGS

The present invention will become more apparent by describing in detail example embodiments thereof with reference to the accompanying drawings, in which.

DETAILED DESCRIPTION OF EXAMPLE EMBODIMENTS

Hereinafter, embodiments of the present invention will be explained in further detail with reference to the accompanying drawings.

Figure 1:
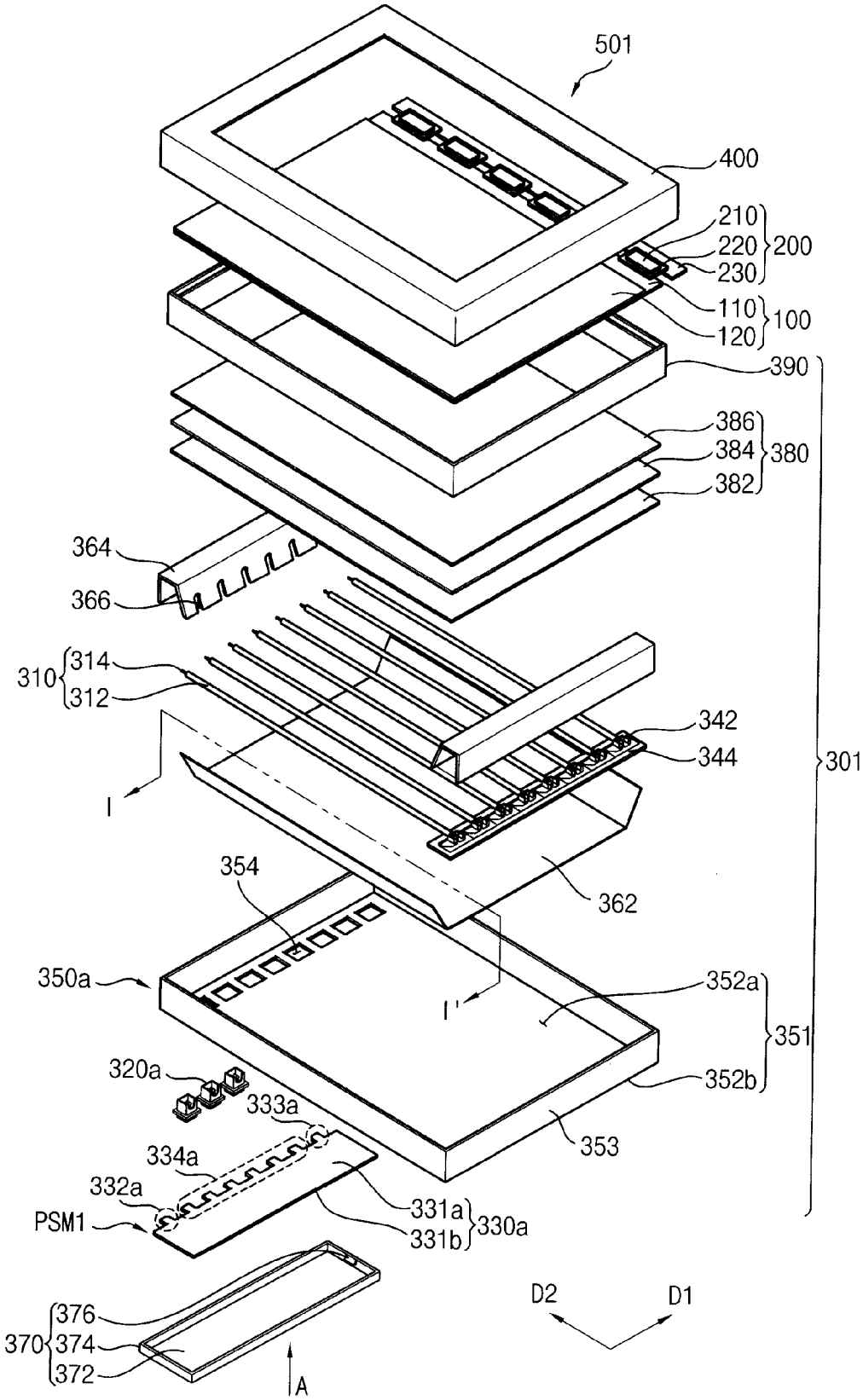
FIG. 1 is an exploded perspective view illustrating a display apparatus according to an example embodiment of the present invention.

FIG. 1 is an exploded perspective view illustrating a display apparatus according to an example embodiment of the present invention.

Figure 2:
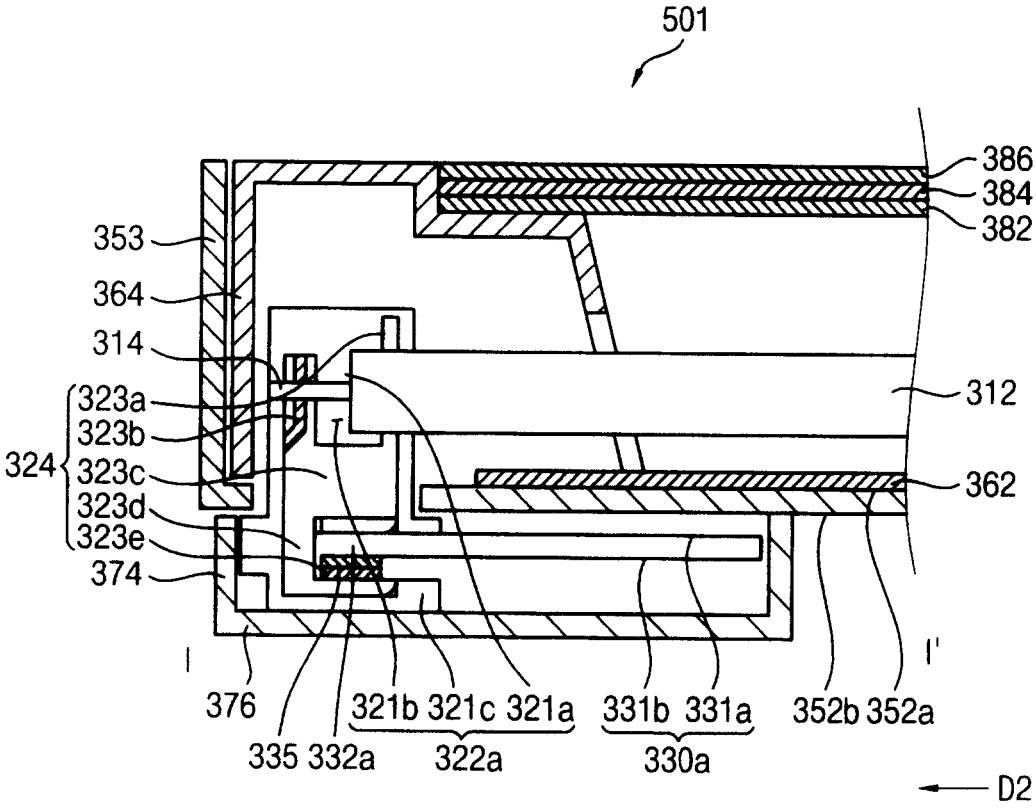
FIG. 2 is a cross-sectional view taken along a line I-I' of FIG. 1.

FIG. 2 is a cross-sectional view taken along a line I-I' of FIG. 1.

Referring to FIGS. 1 and 2, a display apparatus 501 includes a display panel 100, a panel driving part 200, a backlight assembly 301 and a top chassis 400.

The display panel 100 displays an image using light from the backlight assembly 301. According to an embodiment, the display panel 100 includes a display substrate 110, an opposite substrate 120 facing the display substrate 110 and a liquid crystal layer (not shown) disposed between the display substrate 110 and the opposite substrate 120.

The panel driving part 200 drives the display panel 100 by providing a panel driving signal and/or a control signal to the display panel. According to an embodiment, the panel driving part 200 includes a driving chip 210 mounted on a signal transmission substrate 220 and a driving circuit substrate 230 electrically connected to the driving chip 210.

The backlight assembly 301 is disposed under the display panel 100 and provides light to the display panel 100. The backlight assembly 301 includes a plurality of lamps 310, a plurality of lamp sockets 320*a* and a power supplying module PSM1. The backlight assembly 301 may further include a receiving container 350*a*.

In accordance with an embodiment, each of the lamps 310 emits light using a light source driving signal from an external device, and includes a lamp tube 312 and a lamp electrode 314. The lamp electrodes 314 are disposed at opposing end portions of the lamp tube 312. According to an embodiment, the lamps 310 are arranged next to each other along a first direction D1. The arrangement direction of the lamps 310 may vary according to design considerations.

The lamp sockets 320*a* are respectively connected to the lamps 310. Each of the lamp sockets 320*a* corresponds to each of the lamps 310. Each of the lamp sockets is connected to a lamp electrode 314, and provides the light source driving signal to each of the lamps 310. The lamp sockets 320*a* may be arranged next to each other to correspond to end portions of the lamps 310 along the first direction D1. Lamp sockets 320*a* may also be arranged across from each other in a second direction D2, to correspond to opposing ends of a lamp 310. The second direction D2 is perpendicular to the first direction D1. According to the present embodiment, an extension direction of the lamps 310 is the second direction D2. Each of the lamp sockets 320*a* may include a socket terminal part 324 and a socket housing 322*a* covering the socket terminal part 324. The lamp sockets 320*a* will be further described below in connection with FIGS. 5A and 5B referring to FIG. 2.

According to an embodiment, the lamp sockets 320*a* have a relatively longer side extending along the first direction D1 and a relatively shorter side extending along the second direction D2. Alternatively, the lamp sockets 320*a* have a relatively shorter side extending along the first direction D1 and a relatively longer side extending along the second direction D2. According to an embodiment, a socket guide (not shown) includes a plurality of holes spaced apart each other, which correspond to holes 354 formed in the bottom plate 351 of the receiving container 350*a*. The lamp sockets 320*a* may be inserted to the holes of the socket guide and the holes 354, respectively.

Figure 3:
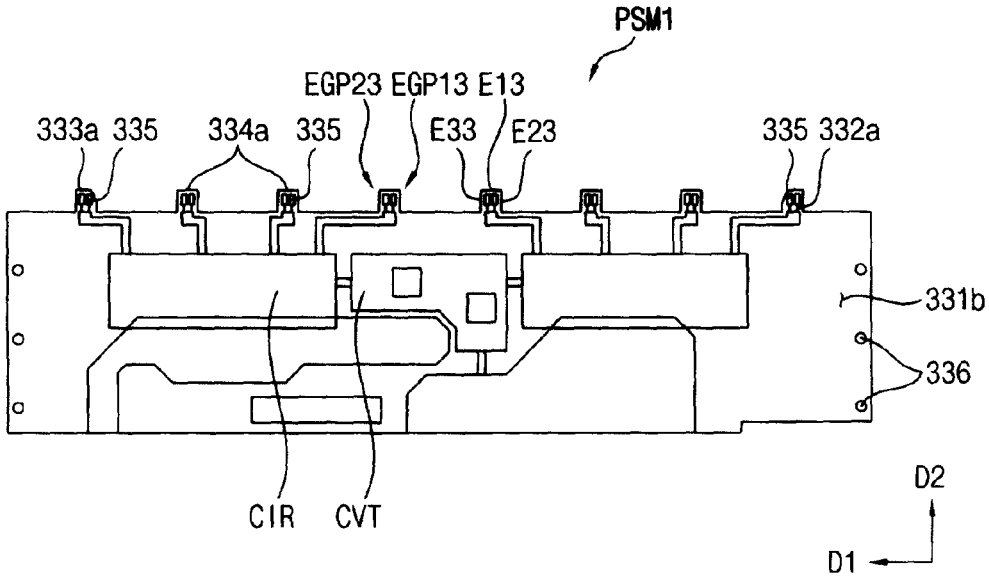
FIG. 3 is a plan view illustrating a printed circuit board (PCB) of FIG. 1 viewed in a direction A.

The power supplying module PSM1 emits a light-source-driving voltage for driving the light source, and is electrically connected to the lamps 310 through the lamp sockets 320*a*. Referring to FIGS. 2 and 3, the power supplying module PSM1 includes a printed circuit board (PCB) 330*a*, a transformer CVT mounted on the PCB 330*a*, and an output terminal 335 electrically connected to a circuit pattern CIR. Each of the output terminals 335 is connected to a respective one of the lamp sockets 320*a*. The light-source-driving voltage is supplied to the lamp sockets 320*a* though the output terminals 335.

Figure 4:
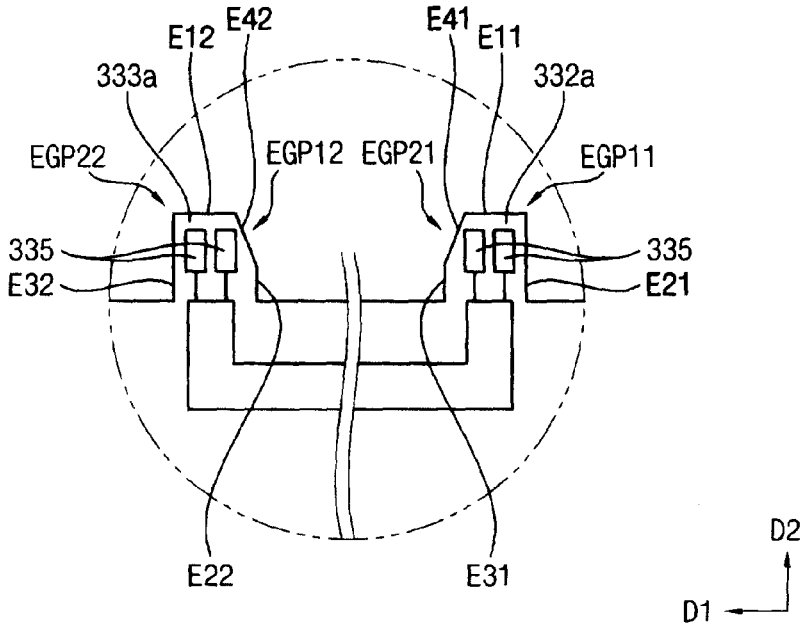
FIG. 4 is an enlarged plan view illustrating a first socket connector and a second socket connector in FIG. 3.

A first surface 331*a* of the PCB 330*a* faces the receiving container 350*a*. A second surface 331*b* of the PCB 330*a* is opposite to the first surface. The transformer CVT, the circuit pattern CIR and the output terminals 335 are mounted on the second surface 331*b*. The PCB 330*a* includes a first socket connector 332*a* and a second socket connector 333*a*. According to an embodiment, the PCB 330*a* further includes a plurality of third socket connectors 334*a*. Referring to FIGS. 3 and 4, on the second surface 331*b*, each of the first, second and third socket connectors 332*a*, 333*a* and 334*a* has an output terminal 335.

Each of the first, second and third socket connectors 332*a*, 333*a* and 334*a* protrudes from a side of the PCB 330*a* that extends along the first direction D1. The first and second socket connectors 332*a* and 333*a* are respectively disposed at opposing end portions of the side of the PCB 330*a* that extends along the first direction. The third socket connectors 334*a* are disposed between the first and second socket connectors 332*a* and 333*a*. The first, second and third socket connectors 332*a*, 333*a* and 334*a* are disposed in a line along the first direction D1. Each of the first, second and third socket connectors 332*a*, 333*a* and 334*a* are respectively inserted in the lamp sockets 320*a*. The PCB 330*a*, including the first, second and third socket connectors 332*a*, 333*a* and 334*a*, will be further described below in connection with FIGS. 3 and 4 referring to FIGS. 1 and 2.

According to an embodiment, the receiving container 350*a* includes a bottom plate 351 and sidewalls 353 connected to the bottom plate 351 to form a receiving space in which the lamps 310 are received. The bottom plate 351 includes a plurality of socket insert holes 354 spaced apart from each other. Each of the lamp sockets 320*a* is inserted in each respective socket insert hole 354. Alternatively, the socket insert holes 354 may be larger to receive more than one lamp socket 320*a*. Thus, a first portion of each of the lamp sockets 320*a* is disposed in the receiving space and electrically connected to the lamp 310. The lamp 310 is disposed on an inner surface 352*a* of the bottom plate 351. In addition, a second portion of the lamp socket 320*a* is disposed outside of the receiving container 350*a* and electrically connected to the power supplying module PSM1. The power supplying module PSM1 faces an outer surface 352*b* of the bottom plate 351. The outer surface 352*b* is positioned opposite to the inner surface 352*a*.

Alternatively, the bottom plate 351 may have one opening extending along the first direction D1. A socket guide having holes in which the lamp sockets 320*a* are inserted may be disposed at the opening. The holes in the socket guide are spaced apart from each other like the holes 354.

Referring to FIG. 1, the backlight assembly 301 may further include a plurality of ground sockets 342, a ground substrate 344, a reflector 362, a side mold 364, optical sheets 380 and a mold frame 390. In addition, according to an embodiment, the backlight assembly 301 includes an inverter cover 370 covering the power supplying module PSM1. The ground sockets 342, the ground substrate 344, the reflector 362, the side mold 364 and the optical sheets 380 may be received in the receiving container 350*a*.

The ground sockets 342 are combined with opposite electrodes disposed opposite to the lamp electrodes 314, which are combined with the lamp sockets 320*a*. The ground substrate 344 guides the ground sockets 342. The lamps 310 are grounded by the ground substrate 344. Alternatively, the ground sockets 342 and the ground substrate 344 may be omitted, the opposite electrodes may be connected to power supplying sockets (not in shown) substantially the same as the lamp sockets 320*a*, and the power supplying sockets may be connected to a power supplying module different from the power supplying module PSM1. Thus, according to an embodiment, two power supplying modules may be disposed on the outer surface 352*b* of the bottom plate 351.

The reflector 362 is disposed between the inner surface 352*a* and the lamps 310. The reflector 362 reflects light, emitted downwardly from the lamps 310 toward the display panel 100.

According to an embodiment, the side molds 364 are disposed at opposing end portions of the lamps 310. The side mold 364 may support the optical sheets 380. The side mold 364 includes a receiving groove 366 enclosing the end portion of the lamp tube 312.

The optical sheets 380 are disposed over the lamps 310. The optical sheets 380 may be spaced apart from the side mold 364 in a vertical direction. For example, the optical sheets 380 may include a diffusing sheet 382, a prism sheet 384 and a protection sheet 386.

The mold frame 390 is disposed under the display panel 100, and supports the display panel 100 and the panel driving part 200. In addition, the mold frame 390 is disposed over the optical sheet 380, and fixes the optical sheet 380 on the side mold 364.

The inverter cover 370 may includes a bottom plate 372 and sidewalls 374 connected to the covering bottom plate 372. The bottom plate 372 faces the second surface 331*b* of the PCB 330*a*, and the power supplying module PSM1 is received in an inner space of the inverter cover 370. The inner space is formed by the bottom plate 372 and the sidewalls 374. At least one of the sidewalls 374 may have a combining protrusion 376 for combining the power supplying module PSM1 with the inverter cover 370.

According to an embodiment, the top chassis 400 is disposed over the display panel 100, and connected to the receiving container 350*a*. The top chassis 400 has an opening exposing a display area of the display panel through which an image is displayed and viewed.

FIG. 3 is a plan view illustrating a printed circuit board (PCB) of FIG. 1 viewed in a direction A.

Referring to FIG. 3, the transformer CVT, the circuit pattern CIR and the output terminals 335 are mounted on the second surface 331*b* of the PCB 330*a*. According to an embodiment, the transformer CVT outputs a driving voltage for the light source by boosting an outside voltage. The circuit pattern CIR includes a capacitor and a protection circuit electrically connected to the capacitor.

The first socket connector 332*a* is disposed at a first side portion of the PCB 330*a*, and the second socket connector 333*a* is disposed at a second side portion. The second side portion is opposite the first side portion in the first direction D1. The third socket connectors 334*a* are disposed between the first side portion and second side portion. According to an embodiment, the first, second and third socket connectors 332*a*, 333*a* and 334*a* are spaced apart from each other by a uniform distance, and disposed in a line along the first direction D1.

According to an embodiment, the PCB 330*a* has combining holes 336 disposed along the second direction D2 at each of the first and second side portions. The PCB 330*a* and the receiving container 350*a* may be physically connected to each other using fixing devices, such as a screws or bolts, in the combining holes 336. In addition, the PCB 330*a* and the inverter cover 370 may be combined with each other using fixing devices and the combining holes 336. For example, the PCB 330*a* may be combined to the inverter cover 370 or the receiving container 350*a* by screws inserted into the combining holes 336.

FIG. 4 is an enlarged plan view illustrating a first socket connector 332*a* and a second socket connector 333*a* in FIG. 3.

Referring to FIGS. 3 and 4, the first socket connector 332*a* includes a first corner portion EGP11 and a second corner portion EGP21 adjacent to each other along the first direction D1. The second corner portion EGP21 has a chamfered edge cutting portion E41. The edge cutting portion E41 is an inclined plane having a predetermined angle, and connecting two edge portions E11 and E31 extending in respective first and second directions. According to embodiments, the edge cutting portion E41 may be a straight line or a curve. The first corner portion EGP11 forms an apex portion having a right angle or substantially a right angle.

For example, according to an embodiment, the first socket connector 332*a* includes a first edge portion E11 substantially parallel with a side of the PCB 330*a*, a second edge portion E21 connected to an end portion of the first edge portion E11, a third edge portion E31 facing the second edge portion E21, and a fourth edge portion (the edge cutting portion) E41 connecting the first edge portion E11 with the third edge portion E31. The first edge portion E11 extends along the first direction D1. Each of the second edge portion E21 and the third edge portion E31 extends along the second direction D2. The third edge portion E31 and the fourth edge portion E41 are spaced apart from the second edge portion E21 along the first direction D1. In this case, the fourth edge portion E41 is inclined with respect to the first direction D1 and the second direction D2. Thus, the second corner portion EGP21 of the first socket connector 332*a* includes the fourth edge portion E41 as the edge cutting portion. The first edge portion E11 and the second edge portion E21 are directly connected to each other without a middle portion such as the fourth edge portion E41, so that the first corner portion EGP11 of the first socket connector 332*a* forms an apex portion having a right angle, or substantially a right angle.

An inclination of the fourth edge portion E41 and/or length of the third edge portion E31 along the second direction D2, and length of the first edge portion E11 along the first direction D1 may vary, based on a length of the PCB 330*a* along the first direction D1 and a size of the display apparatus 501, without damaging the output terminal 335.

The second socket connector 333*a* includes a first corner portion EGP12 and a second corner portion EGP22. The second corner portion EGP22 is adjacent to the first corner portion EGP12 along the first direction D1. The first corner portion EGP12 has the edge cutting portion. The second corner portion EGP22 has the apex portion forming a right angle or substantially a right angle.

For example, the second socket connector 333*a* includes a first edge portion E12, a second edge portion E22, a third edge portion E32, and a fourth edge portion E42. The first edge portion E12 is substantially parallel with a side of the PCB 330*a*. The second edge portion E22 extends along a direction different from an extending direction of the first edge portion E12. The third edge portion E32 faces the second edge portion E22 and is connected to an end portion of the first edge portion E12. The fourth edge portion E42 (the edge cutting portion) connects the first edge portion E12 to the second edge portion E22. The first edge portion E12 extends along the first direction D1. The second edge portion E22 and the third edge portion E32 extend along the second direction D2. The third edge portion E32 is spaced apart from the second edge portion E22 and the fourth edge portion E42 along the first direction D1. The fourth edge portion E42 is inclined with respect to the first and second directions D1 and D2. Thus, the first corner portion EGP12 of the second socket connector 333*a* includes the fourth edge portion E42 as the edge cutting portion. In this case, the fourth edge portion E42 is inclined in a direction different from an incline direction of the fourth edge portion E41 of the first socket connector 332*a*. For example, the fourth edge portion E42 is inclined in an opposite direction from the inclined direction of the fourth edge portion E41. The first edge portion E12 and the third edge portion E32 are directly connected to each other without a middle portion such as the fourth edge portion E42, so that the second corner portion EGP22 of the second socket connector 333*a* has the apex portion forming a right angle or substantially a right angle.

Referring to FIG. 3 again, according to an embodiment, each of the third socket connectors 334*a* includes a first edge portion E13, a second edge portion E23 and a third edge portion E33. The first edge portion E13 is substantially parallel with a side of the PCB 330*a*. The second edge portion E23 connects the first edge portion E13 to the side. The second edge portion E23 is connected to an end of the first edge portion E13. The third edge portion E33 is connected to an opposite end of the first edge portion E13. In each of the third socket connectors 334*a*, the third edge portion E33 is spaced apart from the second edge portion E23 along the first direction D1. A first corner portion EGP13 of the third socket connector 334*a* is formed by connecting the first edge portion E13 with the second edge portion E23. The first corner portion EGP13 has an apex portion forming a right angle or substantially a right angle. In addition, a second corner portion EGP23 of the third socket connector 334*a* is formed by connecting the first edge portion E13 with the third edge portion E33. The second corner portion EGP23 has an apex portion forming a right angle or substantially a right angle.

Figure 5A:
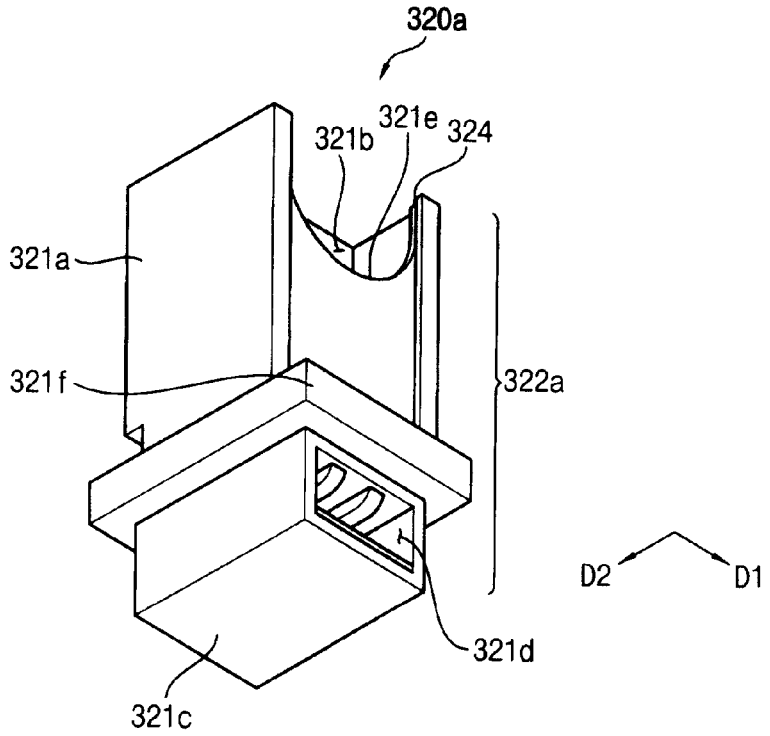
FIG. 5A is a perspective view illustrating a lamp socket in FIG. 1.
Figure 5B:
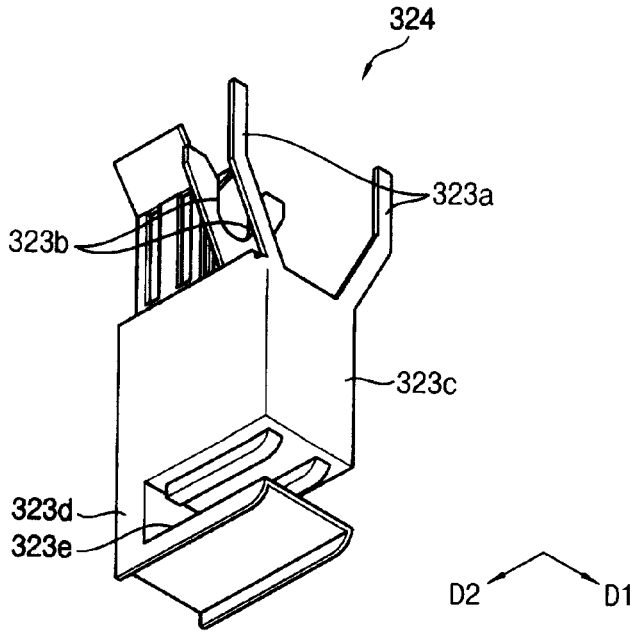
FIG. 5B is a perspective view illustrating a socket terminal portion in FIG. 5A.

FIG. 5A is a perspective view illustrating a lamp socket 320*a* in FIG. 1. FIG. 5B is a perspective view illustrating a socket terminal part 324 in FIG. 5A.

Referring to FIGS. 5A and 5B with FIG. 2, the socket housing 322*a* of each of the lamp sockets 320*a* has a body cover portion 321*a* and a substrate inserting portion 321*c*. The body cover portion 321*a* has an inside space 321*b*. The substrate inserting portion 321*c* is connected to the body cover portion 321*a* and includes an opening 321*d* in which a socket connector of the PCB 330*a* is inserted. The socket housing 322*a* may further include a jaw 321*f* disposed between the body cover portion 321*a* and the substrate inserting portion 321*c*. The socket housing 322*a* protects and insulates the socket terminal part 324. An example of a material that can be used for the socket housing 322*a* is plastic.

The socket terminal part 324 is positioned in the inside space 321*b* of the body cover portion 321*a*. For example, according to an embodiment, the body cover portion 321*a* includes four sidewalls defining the inside space 321*b*, and has a square-pipe shape. The body cover portion 321*a* may include a lamp supporting part 321*e*. A side portion of the body cover portion 321*a* is partially open to form the lamp supporting part 321*e*. The lamp supporting part 321*e* may be formed considering a shape of the lamp tube 312. For example, the lamp supporting part 321*e* may have a U-shape or a C-shape.

The substrate inserting portion 321*c* may includes an opposite portion spaced apart from and facing the body cover portion 321*a*, and sidewalls connecting the opposite portion with the body cover portion 321*a*. When the opposite portion has a square or rectangular shape, three sidewalls are connected to the opposite portion, so that the opening 321*d* may be formed. Thus, the opening 321*d* may have a square or rectangular shape having a closed edge when viewed along the second direction D2. The first, second and third socket connectors 332*a*, 333*a* and 334*a* of the PCB 330*a* are inserted into the substrate inserting portions 321*c* of the lamp sockets 320*a*. The socket terminal part 324 is partially exposed through the substrate inserting portion 321*c*.

According to an embodiment, the jaw 321*f* directly contacts the portion of the bottom plate 351 defining an edge of the socket inserting hole 354 when the lamp socket 320*a* is inserted into the socket inserting hole 354 of the receiving container 350*a*. Thus, being separated by the jaw 321*f*, the body cover portion 321*a* is disposed in an inside space of the receiving container 350*a*, and the substrate inserting portion 321 c is disposed on an outside of the receiving container 350*a* and fixed to the receiving container 350*a*. The jaw 321*f* is protruded more than the body cover portion 321*a* and the substrate inserting portion 321*c*. In other words the jaw 321*f* is wider and longer than the body cover portion 321*a* and the substrate inserting portion 321*c*.

The socket terminal part 324 includes a lamp holder 323*a*, a socket terminal 323*b*, a body 323*c*, a body connector 323*d* and an input terminal 323*e*. The lamp holder 323*a* and the socket terminal 323*b* are connected to a first side of the body 323*c*. The body connector 323*d* and the input terminal 323*e* are connected to a second side of the body 323*c*. The socket terminal 324 is disposed in an inside space of the body cover portion 321*a*, so that the body 323*c* is covered by the body cover portion 321*a*. According to an embodiment, the lamp holder 323*a* and the socket terminal 323*b* are partially exposed through the lamp supporting part 321*e*. The input terminal 323*e* faces the body 323*c*, and is connected to the body 323*c* by the body connector 323*d*. The body connector 323*d* and the input terminal 323*e* form an L-shape, at least roughly, and form a C-shape or U-shape with the body 323*c*. The socket connectors of the PCB 330*a* are disposed between the bodies 323*c* and the input terminals 323*e*.

The input terminals 323*e* are combined with the PCB 330*a*, so that the input terminals 323*e* are connected to the output terminals 335. The input terminal 323*e* faces the body 323*c*. The second surface 331*b* on which the output terminal 335 is mounted is disposed between the body 323*c* and the input terminal 323*e* and faces the input terminal 323*e*, so that the lamp socket 320*a* may be electrically connected to the PCB 330*a*.

Figure 6A:
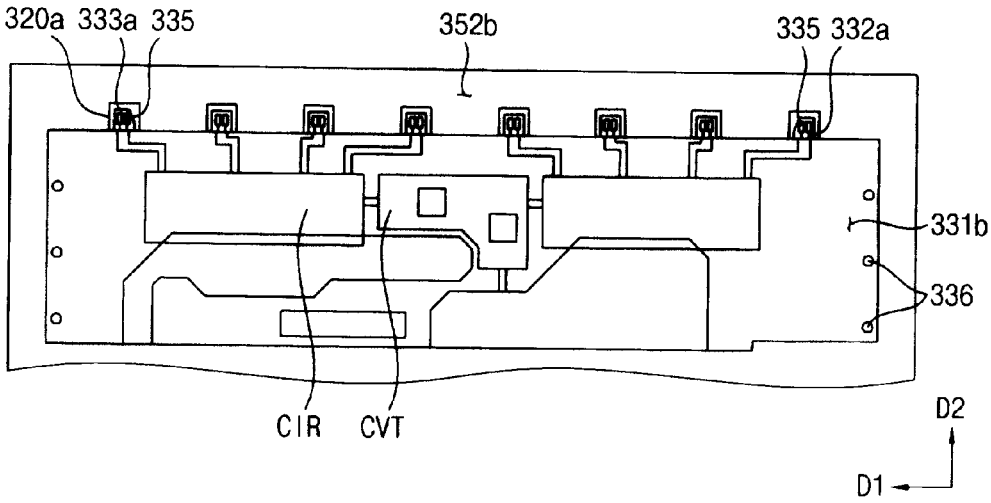
FIGS. 6A, 6B and 6C are plan views illustrating a method for detaching a receiving container from a power supplying module according to an example embodiment of the present invention.
Figure 6B:
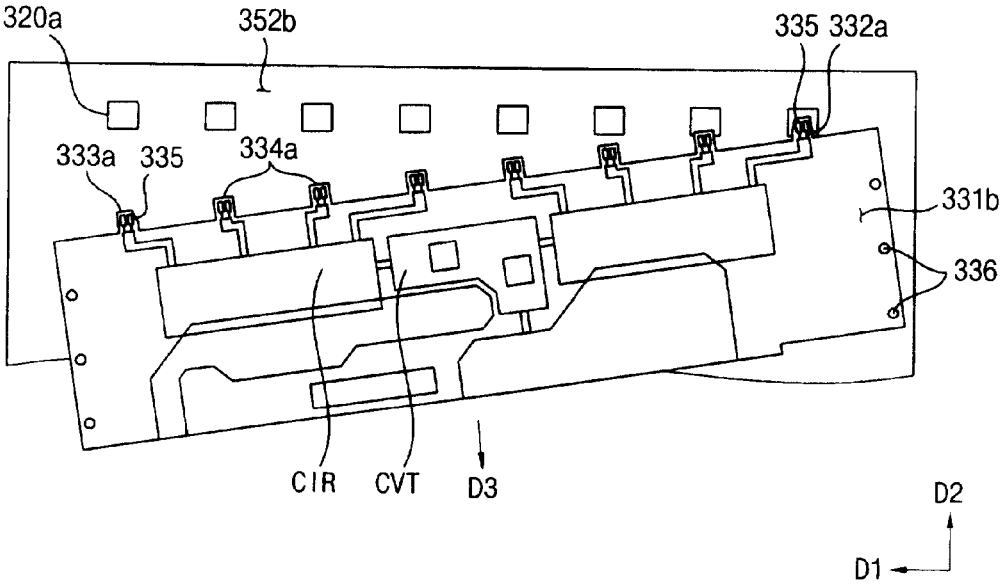
Figure 6C:
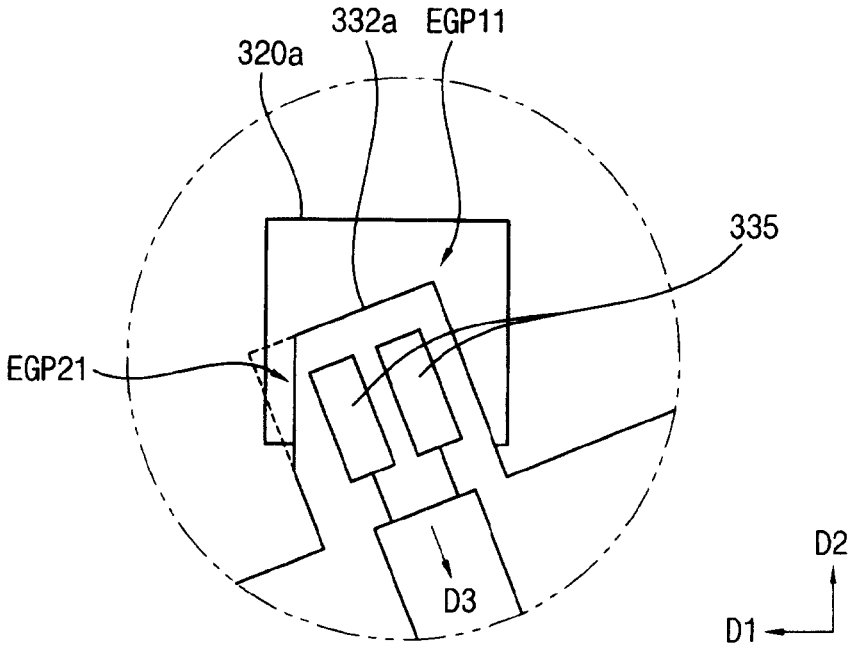

FIGS. 6A, 6B and 6C are plan views illustrating a method for detaching a receiving container from a power supplying module according to an embodiment of the present invention.

For example, FIG. 6A is a plan view illustrating that the power supplying module PSM1 is combined with the lamp sockets 320*a*, which are combined with the receiving container 350*a*. FIG. 6B is a plan view illustrating that the power supplying module PSM1 is moved in a third direction D3 which is at an angle with respect to an opposite direction of the second direction D2. The second direction D2 is an insertion direction of the power supplying module PSM1. The power supplying module PSM1 is moved in the insertion direction to attach the power supplying module PSM1 to the receiving container 350*a*. FIG. 6C is an enlarged plan view illustrating that the power supplying module PSM1 is moved in the third direction D3 when the first socket connector 332*a* is disposed in a corresponding lamp socket 320*a*.

Referring to FIG. 6A, the first, second and third socket connectors 332*a*, 333*a* and 334*a* of the PCB 330*a* are respectively inserted into lamp sockets 320*a*. The PCB 330*a* may be uniformly moved in the second direction D2, so that the PCB 330*a* may be combined with the lamp sockets 320*a*. The PCB 330*a* may be fixed on the outer surface 352*b* of the bottom plate 351.

Referring to FIG. 6B, when forces different from each other are respectively applied to opposing ends of the PCB 330*a*, one of the ends of the PCB 330*a* may be detached from the lamp sockets 320*a*.

For example, when forces different from each other are respectively applied to opposing ends of the PCB 330*a*, the PCB 330*a* is moved in the third direction D3. In this case, the net force applied to the PCB 330*a* is large enough to remove the second socket connector 333*a* from the corresponding lamp socket 320*a*, and small enough so that the first socket connector 332*a* is not removed from its corresponding lamp socket 320*a*. Accordingly, the second socket connector 333*a* is detached from its corresponding lamp socket 320*a*, and the first socket connector 332*a* remains in its corresponding lamp socket 320*a*. Thus, the PCB 330*a* is rotated in a counter-clockwise direction, so that the second socket connector 333*a* may be detached from the lamp socket 320*a*. As can be seen in FIG. 6B, a distance between the socket connectors and the lamp sockets 320*a* increases as a distance from the first socket connector 332*a*, which is a center of the rotation, increases. As can be seen, the second socket connector 333*a* is completely detached from the corresponding socket lamp 320*a*, and some of the third socket connectors 334*a* are detached from their corresponding socket lamps 320*a*. According to an embodiment, the first socket connector 332*a* is the center of the rotation, so that the PCB 330*a* rotates in the counter-clockwise direction while remaining inserted in the lamp socket 320*a*.

Referring to FIG. 6C, as stated above, while a force is applied in the third direction, the first socket connector 332*a* is the center of the rotation, and the PCB 330*a* rotates in the counter-clockwise direction. In this case, if the second corner portion EGP21 of the first socket connector 332*a* did not include the chamfered edge cutting portion E41, and instead included an apex portion formed at, for example, a right angle or substantially a right angle, the apex portion would make contact with an inside of the lamp socket 320*a*, as shown by the dotted lines in FIG. 6C. As a result if force along the third direction D3 were continuously applied, the apex portion would make contact with the inside of the lamp socket 320*a*, thereby generating a crack in the first socket connector 332*a* or the lamp socket 320*a*, or the first socket connector 332*a* may be accidentally detached from the PCB 330*a*.

In the present example embodiment, the second corner portion EGP21 has the edge cutting portion E41, so that the second corner portion and EGP21 does not make contact with or makes little contact with the inside of the lamp socket 320*a* even though the first socket connector 332*a* rotates by a predetermined angle. An angle of the first edge portion E11 with the fourth edge portion E41 is larger than 90°, and an angle of the fourth edge portion E41 with the third edge portion E31 is larger than 90°, so that the force along the third direction is distributed. Therefore, a damage of the first socket connector 332*a* and/or the corresponding lamp socket 320*a* may be minimized or prevented.

In addition, if the PCB 330*a* is moved in a direction opposite to the third direction D3 and is inserted in the lamp sockets 320*a*, the first socket connector 332*a* and the corresponding lamp socket 320*a* make minimal contact with each other, and the force on the PCB 330*a* may be distributed. Thus, when combining the PCB 330*a* with the lamp sockets 320*a*, a damage of the first socket connector 332*a* and/or the corresponding lamp socket 320*a* may be minimized or prevented.

In FIGS. 6B and 6C, the PCB 330*a* is moved in the third direction D3. Alternatively, the second socket connector 333*a* may be the center of rotation rather than the first socket connector 332*a*. In this case, damage of the second socket connector 333*a* and/or the corresponding lamp socket 320*a* may be minimized or prevented due to first corner portion EGP12 of the second socket connector 333*a* having the chamfered edge cutting portion E42.

As explained above, in accordance with an embodiment of the present invention, due to configuration of the second corner portion EGP21 of the first socket connector 332*a* and the first corner portion EGP12 of the second socket connector 333*a*, the PCB 330*a* may be safely combined with and detached from the lamp sockets 320*a*. Thus, a damage of the PCB 330*a*, and/or the corresponding lamp sockets 320*a* may be minimized when combining and detaching the PCB 330*a* with/from the lamp sockets 320*a*.

Figure 7:
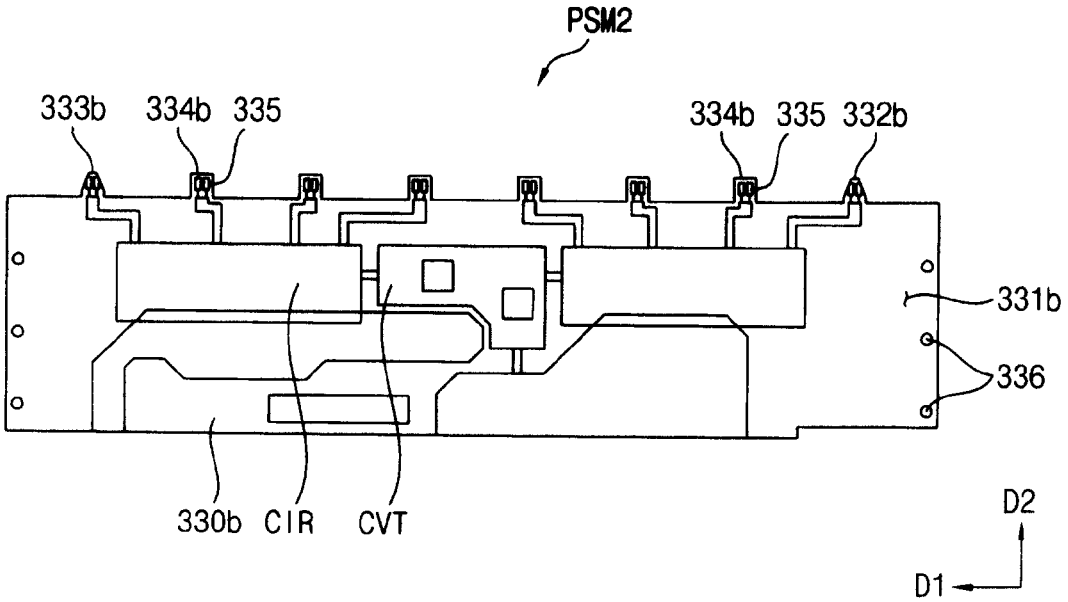
FIG. 7 is a plan view illustrating a power supplying module according to an example embodiment of the present invention.

FIG. 7 is a plan view illustrating a power supplying module according to an example embodiment of the present invention.

The power supplying module PSM2 illustrated in FIG. 7 can substitute for the power supplying module PSM1 and can be used with the display apparatus illustrated in FIGS. 1 and 2.

Referring to FIGS. 1, 2 and 7, a backlight assembly includes a plurality of lamps 310, a plurality of lamp sockets 320*a*, a receiving container 350*a* and a power supplying module PSM2.

The power supplying module PSM2 includes a PCB 330*b*, a transformer CVT, a circuit pattern CIR and output terminals 335. The transformer CVT, the circuit pattern CIR and the output terminal 335 are mounted on a second surface 331*b* of the PCB 330*b*. The second surface 331*b* is opposite to a first surface 331*a* of the PCB 330*b*. The first surface 331*a* faces a bottom plate 351 of the receiving container 350*a*.

The PCB 330*b* includes a first socket connector 332*b* and a second socket connector 333*b*. The first and second socket connectors 332*b* and 333*b* are respectively disposed at opposite end portions of a side of the PCB 330*b* extending along a first direction D1. According to an embodiment, the PCB 330*b* further includes a plurality of third socket connectors 334*b* disposed between the first and second socket connectors 332*b* and 333*b*. The output terminals 335 are respectively disposed at the first, second and third socket connectors 332*b*, 333*b* and 334*b*. According to an embodiment, the PCB 330*b* further includes combining holes 336 through which the receiving container 350*a* and/or inverter cover 370 are combined with the PCB 330*b*.

Each of the first and second socket connectors 332*b* and 333*b* has two corner portions having a chamfered edge cutting portion. In addition, each of the third socket connectors 334*b* has rounded portions at two corner portions.

Figure 8A:
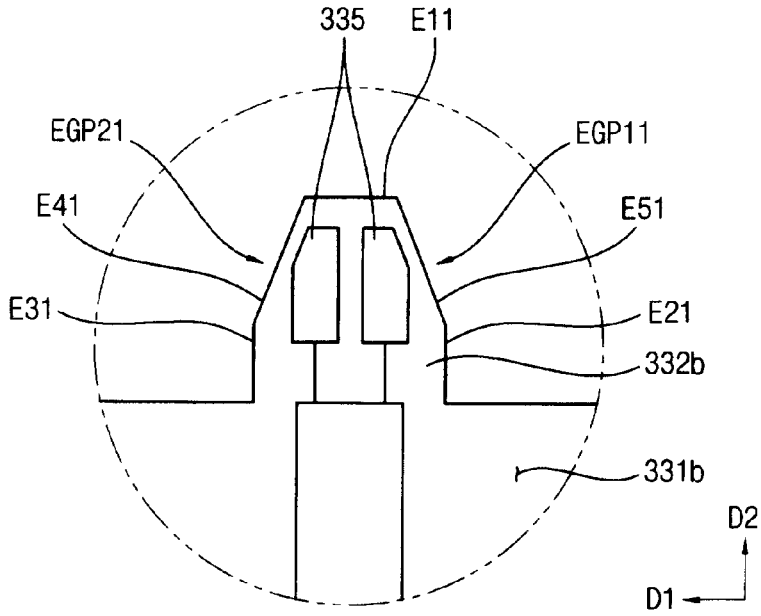
FIGS. 8A and 8B are enlarged plan views respectively illustrating a first socket connector and a third socket connector in FIG. 7.
Figure 8B:
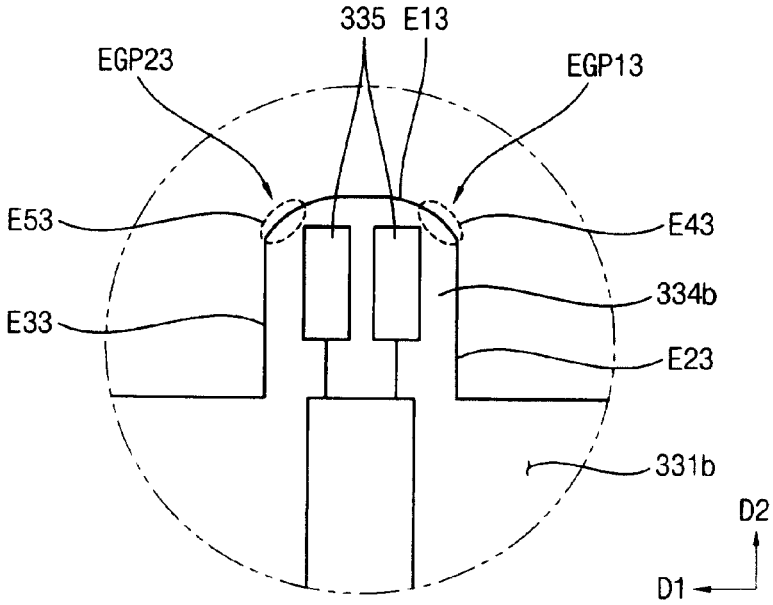

Referring to FIGS. 8A and 8B, the first, second and third socket connectors 332*b*, 333*b* and 334*b* of the PCB 330*b* will be explained in further detail.

FIGS. 8A and 8B are enlarged plan views illustrating a first socket connector 332*b* and a third socket connector 334*b* in FIG. 7.

For example, FIG. 8A is an enlarged plan view illustrating the first socket connector 332*b* in FIG. 7. FIG. 8B is an enlarged plan view illustrating the third socket connector 334*b* in FIG. 7.

Referring to FIG. 8A, the first socket connector 332*b* includes a first corner portion EGP11 and a second corner portion EGP21 disposed on opposite sides of the first socket connector 332*b* along the first direction D1. Each of the first and second corner portions EGP11 and EGP21 has an edge cutting portion E51 and E41, respectively.

For example, the first socket connector 332*b* includes a first edge portion E11 substantially parallel with a side of the PCB 330*b*, second and third edge portions E21 and E31 extending along a second direction D2 different from the first direction D1 (e.g., perpendicular to the first direction D1) and connected to the side of the PCB 300*b*. The fourth edge portion E41 (i.e., the edge cutting portion) connects the first edge portion E11 with the third edge portion E31, and a fifth edge portion E51 (i.e., the other edge cutting portion) connects the second edge portion E21 with the first edge portion E11. The fourth edge portion E41 and the fifth edge portion E51 are inclined in a directions different from the first and second directions D1 and D2. The fifth edge portion E51 is inclined in a direction crossing the fourth edge portion E41, and the fourth edge portion E41 is inclined in a direction crossing the fifth edge portion E51. Thus, the first corner portion EGP11 has a chamfered edge cutting portion formed by the fifth edge portion E51. The second corner portion EGP21 has an edge cutting portion formed by the fourth edge portion E41.

An inclination of each of the fourth and fifth edge portions E41 and E51, and length of the second and third edge portions E21 and E31 in the second direction D2 may vary, based on, for example, a length of the PCB 330*b* in the first direction D1 and a size of the display apparatus including the power supplying module PSM2, within the scope in which a damage of the output terminals 335 may be minimized or prevented.

The second socket connector 333*b* is substantially the same as the first socket connector 332*b* except that the second socket connector 333*b* is disposed at a second side of the PCB 330*b*. The second side is opposite to a first side of the PCB 330*b* at which the first socket connector 332*b* is disposed. Thus, detailed explanation concerning the second socket connector 333*b* is omitted.

Referring FIG. 8B, each of the third socket connectors 334*b* includes first and second corner portions EGP13 and EGP23. Each of the first and second corner portions EGP13 and EGP23 has a predetermined curvature, and the second corner portion EGP23 is disposed on an opposite side of the third socket connector 334*b* than the first corner portion EGP13 along the first direction D1.

For example, according to an embodiment, each of the third socket connectors 334*b* includes a first edge portion E13 substantially parallel with a side of the PCB 330*b* extending along the first direction D1, second and third edge portions E23 and E33 extending from the side along the second direction D2, a fourth edge portion E43 connecting the first edge portion E13 with the second edge portion E23, and a fifth edge portion E53 connecting the first edge portion E13 with the third edge portion E33. Each of the fourth and fifth edge portions E43 and E53 has a predetermined curvature. Thus, the first corner portion EGP 13 of the third socket connectors 334*b* includes the fourth edge portion E43 having a predetermined curvature. The second corner portion EGP23 of the third socket connectors 334*b* includes the fifth edge portion E53 having a predetermined curvature.

According to an embodiment, the third socket connectors 334*b* may be applied to a PCB 330*a* instead of the third socket connectors 334*a* disposed between the first and second socket connectors 332*a* and 333*a* in FIG. 3.

Since the first and second corner portions EGP13 and EGP23 of the third socket connectors 334*b* have the predetermined curvature, the PCB 330*b* may be inserted into or detached from lamp sockets 320*a* with less force than when the first and second corner portions EGP13 and EGP23 do not have the predetermined curvature, as illustrated in FIG. 3.

Alternatively, each of the fourth and fifth edge portions E43 and E53 has a straight line shape, such that the first and second corner portions EGP13 and EGP 23 have a chamfered edge cutting portion respectively connecting edge portion E23 with edge portion E13, and edge portion E33 with edge portion E13. When the third socket connectors 334*b* have a same or substantially the same structure as the first socket connector 332*b*, attachment between the PCB 330*b* and lamp sockets 320*a* is weakened, so that the PCB 330*b* may be easily detached from the lamp sockets 320*a*. Therefore, for example, according to an embodiment, length of the second and third edge portions E23 and E33 in the second direction D2 is longer than length of the second and third edge portions E21 and E22, and E31 and E32 of the first and second socket connectors 332*b* and 333*b* in the second direction D2.

According to the above-mentioned example embodiment, two corner portions of each of the first and second socket connectors 332*b* and 333*b* have an edge cutting portion, and two of the leading corner portions of each of the third socket connectors 334*b* have a rounding portion having a predetermined curvature, so that the PCB 330*b* may be safely combined with and detached from the lamp sockets 320*a* with a relatively small force. Thus, a damage of the PCB 330*b* and/or to the lamp sockets 320*a* may be minimized or prevented when combining and detaching the PCB 330*b* with/from the lamp sockets 320*a*.

Figure 9:
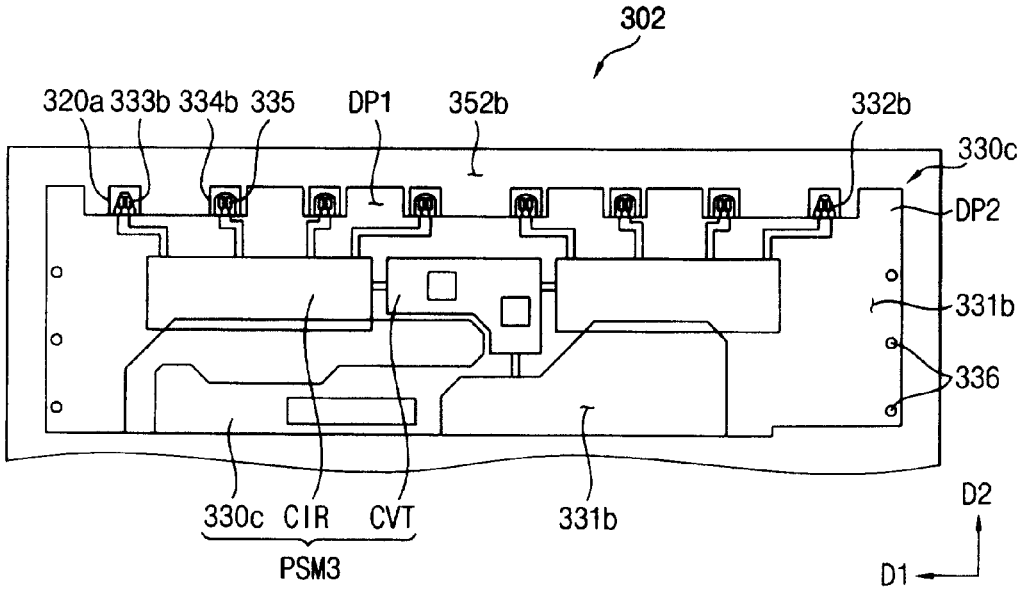
FIG. 9 is a plan view illustrating a power supplying module according to an example embodiment of the present invention.

FIG. 9 is a plan view illustrating a power supplying module according to an example embodiment of the present invention.

The power supplying module PSM3 illustrated in FIG. 9 can substitute for the power supplying module PSM1 and can be used with the display apparatus illustrated in FIGS. 1 and 2.

Referring to FIGS. 1, 2 and 9, a backlight assembly 301 of the display apparatus includes a plurality of lamps 310, a plurality of lamp sockets 320*a*, a receiving container 350*a* and a power supplying module PSM3.

The power supplying module PSM3 includes a PCB 330*c*, a transformer CVT, a circuit pattern CIR and output terminals 335. The transformer CVT, the circuit pattern CIR and the output terminal 335 are mounted on a second surface 331*b* of the PCB 330*c*. The second surface 331*b* is opposite to a first surface 331*a* of the PCB 330*c*. The first surface 331*a* faces a bottom plate 351 of the receiving container 350*a*.

The PCB 330*c* may include a first socket connector 332*b*, a second socket connector 333*b*, a plurality of third socket connectors 334*b* and dummy protrusions DP1 and DP2. The first and second socket connectors 332*b* and 333*b* are respectively disposed at opposite end portions of a side of the PCB 330*c* extending along a first direction D1. Each of the output terminals 335 is disposed at each of the first, second and third socket connectors 332*b*, 333*b* and 334*b*. The first, second and third socket connectors 332*b*, 333*b* and 334*b* according to the present example embodiment are the same or substantially the same as the first, second and third socket connectors explained in connection with FIG. 7. Thus, any repetitive explanation concerning the first, second and third socket connectors 332*b*, 333*b* and 334*b* will be omitted.

The dummy protrusions DP1 and DP2 are protruded in a second direction different from the first direction D1. Each of the dummy protrusions DP1 and DP2 may be disposed at a side of the first, second and third socket connectors 332*b*, 333*b* and 334*b*. The dummy protrusions DP1 and DP2 may be spaced apart from each other, and be positioned on an outside of the first, and second socket connectors 332*b* and 333*b*, and between third socket connectors 334*b*. According to an embodiment, an end portion of each of the dummy protrusions DP1 and DP2 is disposed in line with an end potion of the lamp sockets 320*a*. According to an embodiment, the dummy protrusions DP1 and DP2 include a first dummy protrusion DP1 disposed between third socket connectors 334*b* adjacent to each other, and a second dummy protrusion DP2 disposed at a side portion adjacent to the first or second socket connector 332*b* or 333*b*.

According to an embodiment, lamp sockets 320*a* adjacent to each other are disposed on both sides of a first dummy protrusion DP1 in the first direction D1. In addition, the lamp socket 320*a* are disposed between first dummy protrusions DP1 adjacent each other. According to an embodiment, the second dummy protrusion DP2 is disposed at a side of the PCB 330*c* adjacent to the first or second socket connector 332*b* or 333*b*.

According to an embodiment, although forces different from each other are applied at opposing end portions of the PCB 330*c* when detaching the PCB 330*c* from the lamp sockets 320*a*, the dummy protrusions DP1 and DP2 support the PCB 330*c*, between the lamp sockets 320*a* adjacent to each other, until the first socket connector 332*b* and the second socket connector 333*b* are detached from the lamp sockets 320*a*. Accordingly, due to the dummy protrusions DP1 and DP2, a force that is not uniformly applied at a side of the PCB 330*c* can be uniformly distributed to the whole side of the PCB 330*c*. Therefore, damage of the first or second socket connector 332*b* or 333*b*, and/or to the lamp sockets 320*a* may be minimized or prevented.

In FIG. 9, the PCB 330*c* is the PCB 330*b* of FIG. 7 including the dummy protrusions DP1 and DP2. According to an embodiment, the PCB 330*a* in FIG. 3 may also include the dummy protrusions DP1 and DP2.

According to an example embodiment, the PCB 330*c* includes the dummy protrusions DP1 and DP2 in addition to the first, second and third socket connectors 332*b*, 333*b* and 334*b*, so that the PCB 330*c* and the lamp sockets 320*a* may be safely combined with and detached from each other. Damage of the first, second and third socket connectors 332*b*, 333*b* and 334*b*, and/or to the lamp sockets 320*a* may be minimized or prevented when detaching the PCB 330*c* from the lamp sockets 320*a*.

Figure 10:
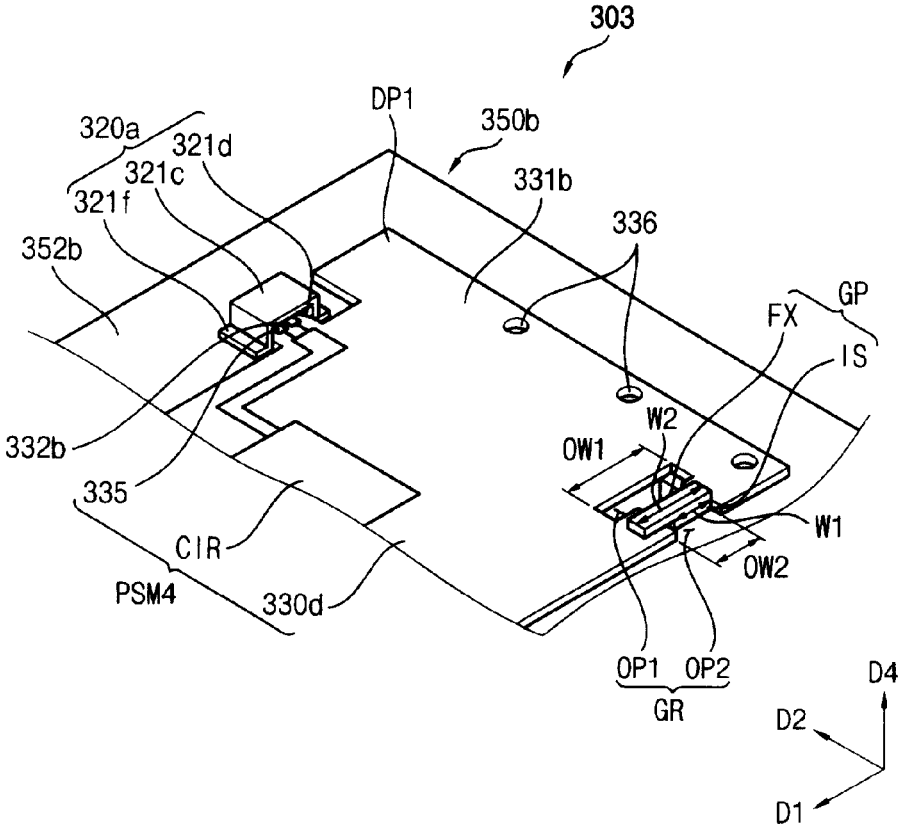
FIG. 10 is a perspective view partially illustrating a backlight assembly according to an example embodiment of the present invention.

FIG. 10 is a perspective view partially illustrating a backlight assembly according to an example embodiment of the present invention.

A display apparatus according to the embodiment described in connection with FIG. 10 is substantially the same as the display apparatus 501 in FIGS. 1 and 2, except that the backlight assembly includes a receiving container and a power supplying module PSM4 illustrated in FIG. 10.

Referring to FIG. 10 with FIGS. 1 and 2, the backlight assembly 303 includes a plurality of lamps 310, a plurality of lamp sockets 320*a*, a receiving container 350*b* and a power supplying module PSM4.

The power supplying module PSM4 includes a PCB 330*d*, a transformer CVT, a circuit pattern CIR and output terminals 335. The transformer CVT, the circuit pattern CIR and the output terminals 335 are mounted on a second surface 331*b* of the PCB 330*d*. The second surface 331*b* is opposite to a first surface 331*a* of the PCB 330*d*. The first surface 331*a* faces a bottom plate 351 of the receiving container 350*b*.

The PCB 330*d* includes a first socket connector 332*b*, a second socket connector 333*b*, third socket connectors 334*b* and a guide groove GR. The first and second socket connectors 332*b* and 333*b* are respectively disposed at opposing end portions of a side of PCB 330*d* extending along a first direction D1. Each of the output terminals 335 is disposed at each of the first, second and third socket connectors 332*b*, 333*b* and 334*b*. According to an embodiment, the PCB 330*d* further includes combining holes 336 through which fixing devices are penetrated to combine the PCB 330*d* with the receiving container 350*b* and/or inverter cover 370. The PCB 330*d* is substantially same as the PCB 330*c* in FIG. 9, except for the guide groove GR.

According to an embodiment, the guide groove GR has a first opening OP1 and a second opening OP2 connected to the first opening OP1. The guide groove GR is formed through the PCB 330*d*. According to an embodiment, the bottom plate 351 is exposed through the guide groove GR.

A width of the first opening OP1 in the first direction D1 is referred to as a first opening width OW1. The second opening OP2 is disposed adjacent to the first opening OP1 in a direction opposite to a second direction D2. A width the second opening OP2 in the first direction D1 is referred to as a second opening width OW2. The first opening width OW1 is larger than the second opening width OW2. Thus, according to embodiment, the guide groove GR may have an L-shape or a T-shape. The receiving container 350*b* includes a guide protrusion GP formed on the bottom plate 351. The guide protrusion GP is combined with the guide groove GR and protrudes toward an outside direction D4 of the bottom plate 351. According to an embodiment, the guide protrusion GP is formed by connecting an additional part to the bottom plate 351. Alternatively, the guide protrusion GP is formed by cutting and bending a portion of the bottom plate 351 toward the outside direction D4 of the bottom plate 351.

The guide protrusion GP includes an insert portion IS and a fixing portion FX connected to the insert portion IS. The insert portion IS is directly connected to the bottom plate 351, and has a first width W1 in the first direction D1. The fixing portion FX is connected to the insert portion IS, and disposed on the insert portion IS. For example, the insert portion IS may be disposed between the fixing portion FX and the bottom plate 351. The fixing portion FX has a second width W2 in the first direction D1. According to an embodiment, the second width W2 is larger than the first width W1 and is larger than the second opening width OW2. The second opening width OW2 may be substantially the same as or smaller than the first opening width OW1.

Accordingly, when the insert portion IS is disposed in the second opening OP2, the PCB 330*d* may be safely combined with the lamp sockets 320*a* and the bottom plate 351. According to an embodiment, an end portion of the fixing portion FX overlaps with the bottom plate 351. For example, the PCB 330*d* is partially disposed between the end portion of the fixing portion FX and the bottom plate 351.

Figure 11:
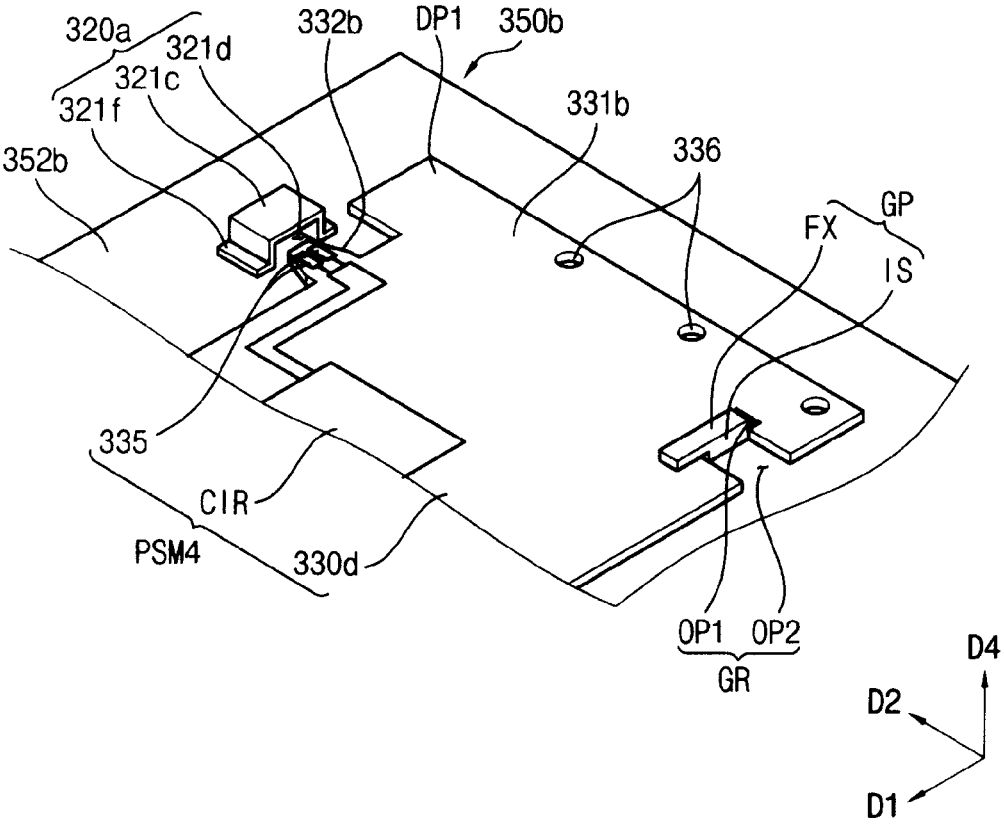
FIG. 11 is a perspective view illustrating a method of combining a receiving container with a power supplying module according to an example embodiment of the present invention.

FIG. 11 is a perspective view illustrating a method of combining a receiving container with a power supplying module in FIG. 10.

Referring to FIG. 11, the PCB 330*d* is moved toward the bottom plate 351 in a direction opposite to the outside direction D4, and the guide protrusion GP is disposed in the first opening OP1. The second width W2 of the fixing portion FX is substantially the same as or smaller than the first opening width OW1 of the first opening OP1, so that the fixing portion FX may be disposed in the first opening OP1, and the guide protrusion GP may be inserted in the first opening OP1. Thus, the insert portion IS is disposed in the first opening OP1, and the fixing portion FX faces the first opening OP1. At this time, the first socket connector 332*b* may be disposed adjacent to the opening 321*d* of the lamp socket 320*a* without being inserted into the lamp socket 320*a*.

When the insert portion IS is disposed in the first opening OP1, as the PCB 330*d* moves along the second direction D2, the PCB 330*d* is partially inserted into the lamp sockets 320*a* and the insert portion IS is disposed in the second opening OP2. The fixing portion FX now faces the second opening OP2. The second opening width OW2 of the second opening OP2 is smaller than the second width W2 of the fixing portion FX, so that the fixing portion FX may face the second opening OP2 and a portion of the PCB 330*d*. Thus, the guide protrusion GP may be combined with the guide groove GR as illustrated in FIG. 10.

According to an embodiment, when the insert portion IS is disposed in the second opening OP2, as the PCB 330*d* moves in an opposite direction of the second direction D2, the insert portion IS may move from the second opening OP2 to the first opening OP1. When the PCB 330*d* is moved toward the opposite direction of the second direction D2, the insert portion IS is disposed in the second opening OP2, so that the PCB 330*d* may not move in the first direction D1 or in an opposite direction of the first direction D1. In addition, by the fixing portion FX, the PCB 330*d* movies prevented from moving in the outside direction D4 or an opposite direction of the outside direction D4. Thus, a state illustrated in FIG. 11 may safely progress to a state illustrated in FIG. 10.

According to an embodiment, when inserting or detaching the PCB 330*d* into or from the lamp sockets 320*a*, due to the guide groove GR and the guide protrusion GP, the PCB 330*d* may be prevented from moving in the first direction D1, the outside direction D4 or in directions opposite to the first direction D1 and the outside direction D4. Thus, damage of the PCB 330*d* may be minimized or prevented when combining and detaching the PCB 330*d* with/from the lamp sockets 320*a*.

In FIGS. 10 and 11, although the PCB 330*d* includes the first, second and third socket connectors 332*b*, 333*b* and 334*b* illustrated in FIG. 9, according to an embodiment, the PCB 330*d* may include a first, second and third socket connectors 332*a*, 333*a* and 334*a* illustrated in FIG. 3.

Figure 12:
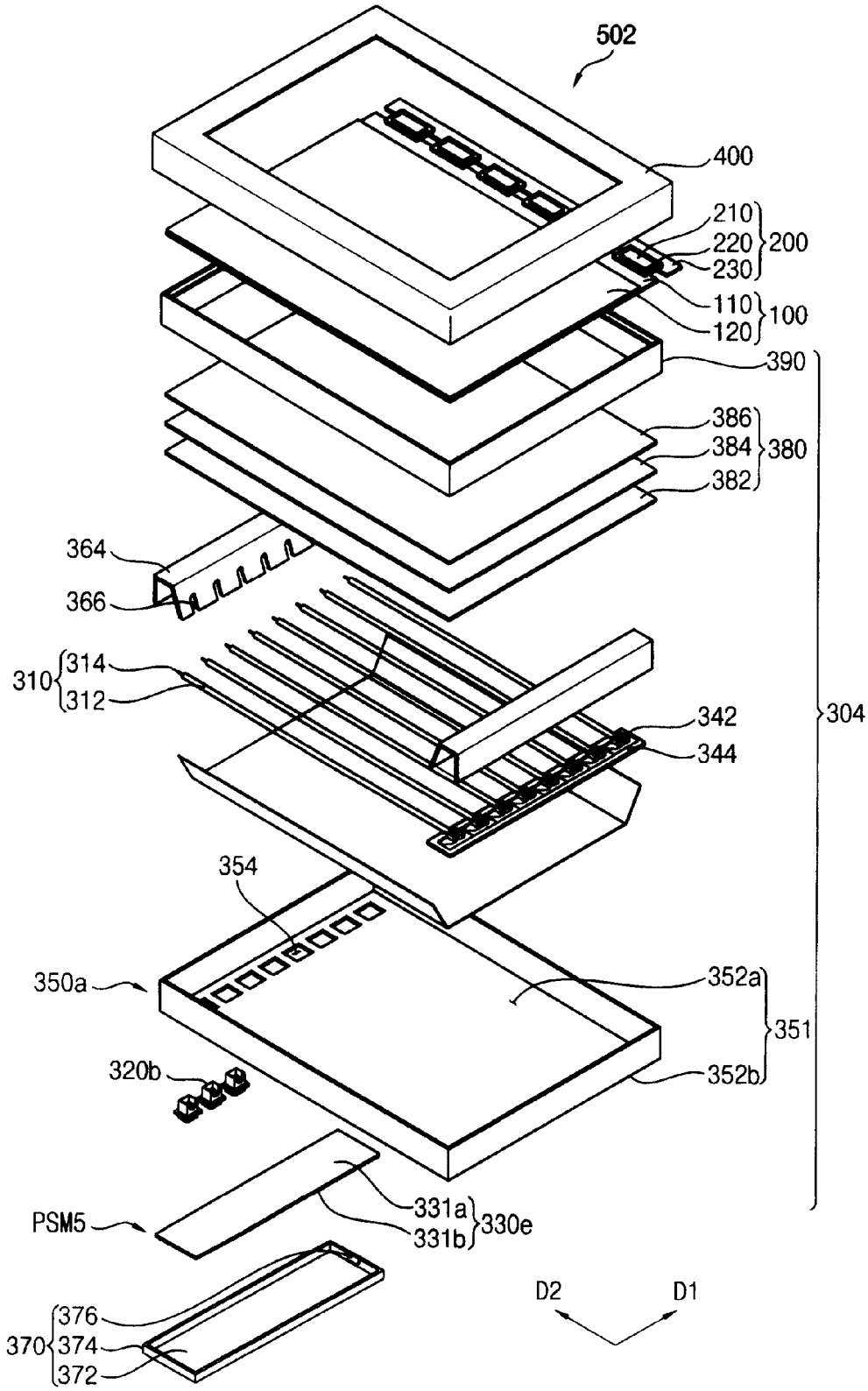
FIG. 12 is an exploded perspective view illustrating a display apparatus according to an example embodiment of the present invention.

FIG. 12 is an exploded perspective view illustrating a display apparatus according to an example embodiment of the present invention.

The display apparatus 502 according to the embodiment described in connection with FIG. 12 is substantially the same as the display apparatus in FIGS. 1 and 2 except for a backlight assembly 304. The backlight assembly 304 according to the present example embodiment is substantially the same as the backlight assembly explained in FIGS. 1 and 2 expect for a power supplying module PSM5 and lamp sockets 320*b*.

Figure 14A:
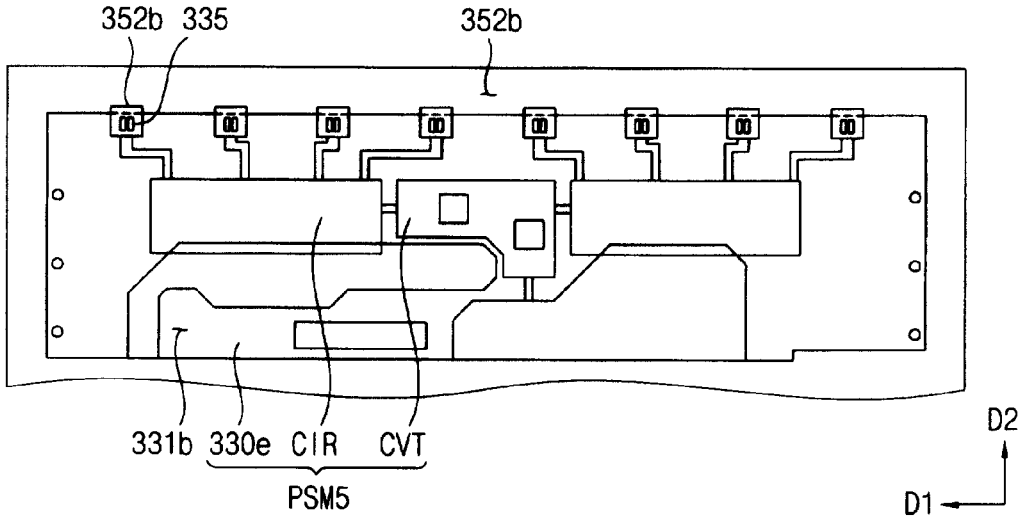
FIGS. 14A and 14B are plan views illustrating a method of detaching a receiving container from a power supplying module according to an example embodiment of the present invention.

Referring to FIG. 12, the power supplying module PSM5 of the backlight assembly 304 includes a PCB 330*e*. A second surface 331*b* of the PCB 330*e* is opposite to a first surface 331*a* of the PCB 330*e*. The first surface 331*a* faces a bottom plate 351 of the receiving container 350*a*. Referring to FIG. 14A, a transformer CVT, a circuit pattern CIR and an output terminal 335 may be disposed on the second surface 331*b*.

The PCB 330*e* has a straight edge extending along a first direction along which lamps 310 are arranged. The output terminals 335 are disposed on the straight edge in a line along the first direction D1. For example, the PCB 330*e* may have a rectangular shape having a relatively longer side extending along the first direction D1. The output terminals 335 may be respectively and electrically connected to the lamps 310 through lamp sockets 320*b*.

Figure 13:
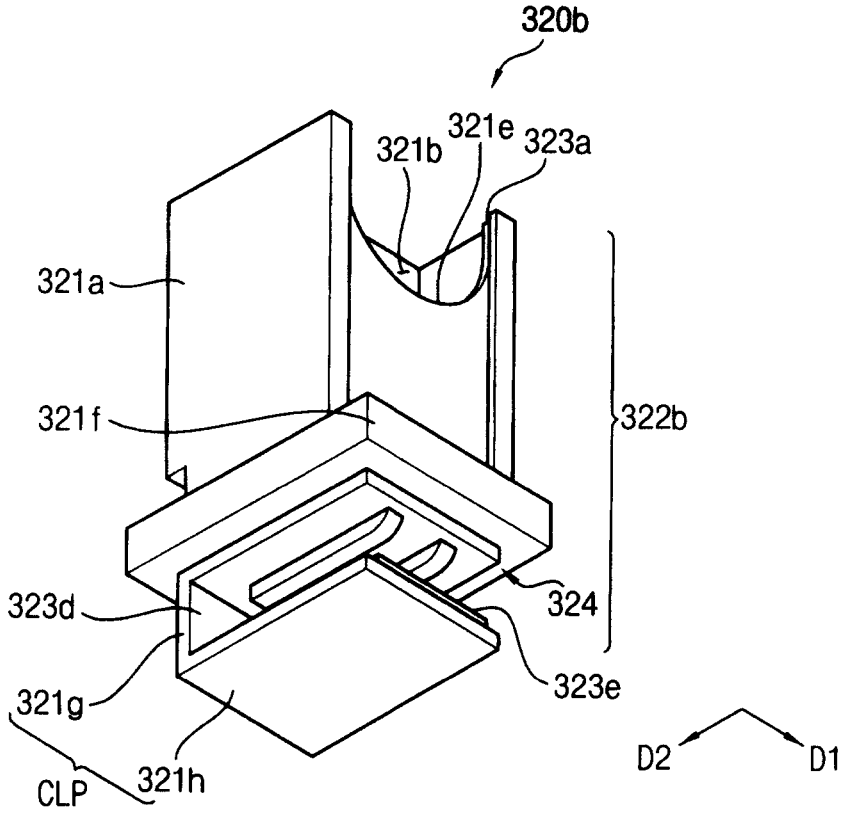
FIG. 13 is an enlarged perspective view illustrating a lamp socket in FIG. 12.

FIG. 13 is an enlarged perspective view illustrating a lamp socket in FIG. 12.

Referring to FIG. 13, each of the lamp sockets 320*b* includes a socket housing 322*b* and a socket terminal part 324. The socket housing 322*b* includes a clip portion CLP. The socket housing 322*b* covers the socket terminal part 324. The socket terminal part 324 may be substantially the same as the socket terminal part 324 explained in FIG. 5B. According to an embodiment, the socket terminal part 324 includes a lamp holder 323*a*, a socket terminal 323*b*, a body 323*c*, a body connector 323*d* and an input terminal 323*e*. The input terminal 323*e* directly makes contact with the output terminal 335.

According to an embodiment, the clip portion CLP of the socket housing 322*b* partially encloses the straight edge of the PCB 330*e*. In addition, the clip portion CLP is connected to a body cover portion 321*a* of the socket housing 322*b*. The body cover portion 321*a* includes an inside space 321*b*. The socket terminal part 324 is disposed in the inside space 321*b*. The body cover portion 321*a* includes a lamp supporting part 321*e*, and a sidewall of the body cover portion 321*a* is partially open to form the lamp supporting part 321*e*.

According to an embodiment, the clip portion CLP includes an input terminal receiver 321*h* facing the body cover portion 321*a*, and a connector 321*g* connecting the body cover portion 321*a* with the input terminal receiver 321*h*. The input terminal 323*e* of the socket terminal part 324 is disposed on the input terminal receiver 321*h*. The connector 321*g* is connected to an end portion of the input terminal receiver 321*h*, and connects the body cover portion 321*a* to the input terminal receiver 321*h*. The body connector 323*d* of the socket terminal part 324 is disposed in a position corresponding to the connector 321*g*.

According to an embodiment, a main surface of the input terminal receiver 321*h* is substantially perpendicular to that of the connector 321*g*, so that the clip portion CLP has an L-shape. In addition, the body cover portion 321*a* and the input terminal receiver 321*h* are spaced apart from each other by the connector 321*g*, so that the socket housing 322*b* may have a U-shape or C-shape. According to an embodiment, the input terminal receiver 321*h* is disposed adjacent to the second surface 331*b* of the PCB 330*e*. The body cover portion 321*a* is disposed adjacent to the first surface 331*a*. The connector 321*g* faces the straight edge of the PCB 330*e*.

Figure 14B:
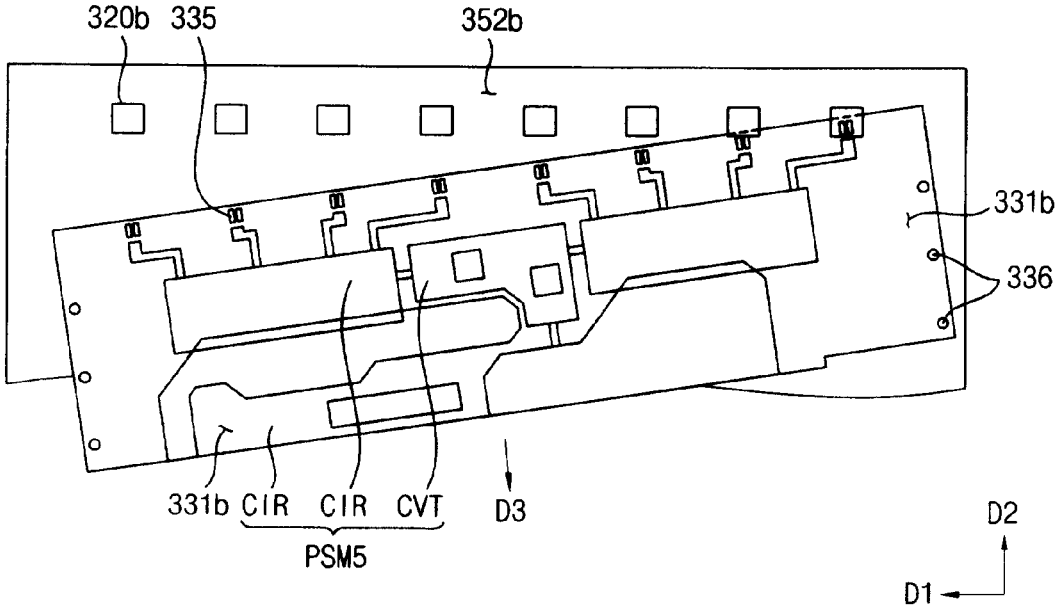

FIGS. 14A and 14B are plan views illustrating a method of detaching a receiving container from a power supplying module in FIG. 12.

FIG. 14A is a plan view illustrating that the lamp sockets 320*b* and the PCB 330*e* are combined with each other, and FIG. 14B is a plan view explaining a process of detaching the PCB 330*e* from a state illustrated in FIG. 14A.

Referring to FIG. 14A, the socket housing 322*b* includes the clip portion CLP, so that the lamp sockets 320*b* are inserted in a portion of the straight edge in which the output terminals 335 are formed, and a portion of the straight edge between the output terminals 335 may be disposed between the lamp sockets 320*b*. The straight edge of the PCB 330*e* may be disposed in substantially the same line with the lamp sockets 320*b*.

Referring to FIG. 14B, when forces different from each other are respectively applied to opposing ends of the PCB 330*e*, one of the ends of the PCB 330*e* is first detached from the lamp sockets 320*b*. For example, when a first end of the PCB 330*e* is forced in direction D2 stronger than a second end thereof, the second end may be detached from the lamp sockets 320*b* and the first end may remain partially inserted in the lamp sockets 320*b*. Thus, the PCB 330*e* may be rotated in a counter-clockwise direction, the first end rotates in the counter-clockwise direction while remaining inserted in the lamp socket 320*b*. In this case, the lamp socket 320*b* includes the clip portion CLP, so that the first end does not make or makes little contact with the lamp socket 320*b* although the first end rotates in the counter--clockwise direction while remaining inserted in the lamp socket 320*b*. In addition, the PCB 330*e* has a straight edge so that the force may be uniformly distributed to the whole edge.

As stated above, the straight edge of the PCB 330*e* is inserted into and detached from the clip portion CLP, so that damage of the PCB 330*e* and/or the lamp sockets 320*b* may be minimized or prevented.

Although not shown in figures, according to an embodiment, the PCB 330*e* in FIGS. 12, 13, 14A and 14B may further include the guide groove GR in FIG. 10. In this case, the receiving container 350*a* may be replaced by the receiving container 350*b* further including the guide protrusion GP in FIG. 10.

As mentioned above, a shape of the lamp sockets 320*b* is changed from the shape of the lamp sockets 320*a*, and the PCB 330*e* having a straight edge extending in the first direction D1 is combined with and separated from the lamp sockets 320*b*, so that damage of the PCB 330*e* and/or the lamp sockets 320*b* may be minimized or prevented.

As detailed mentioned above, according to embodiments of the present invention, a PCB of a power supplying module may be safely combined with and detached from a lamp socket. Thus, damage of the PCB and/or the lamp sockets may be minimized, and reliability of a product may be improved when combining or detaching the PCB with or from the lamp sockets.

The foregoing is illustrative of the embodiments of the present invention and is not to be construed as limiting thereof. Although a few example embodiments of the present invention have been described, those skilled in the art will readily appreciate that many modifications are possible. Accordingly, all such modifications are intended to be included within the scope of the embodiments of the present invention as defined in the claims.

What is claimed is:

1. A power supplying module comprising:

a printed circuit board (PCB) comprising a first socket connector protruding from a side of the PCB toward a second direction, the side of the PCB extending along a first direction different from the second direction, the first socket connector comprising a first edge portion extending along the first direction, and a second edge portion extending along the second direction, and at least one corner of the first socket connector having a chamfered edge connecting the first and second edge portions;

a transformer formed on the printed circuit board;

a circuit pattern formed on the PCB and connected to the transformer; and an output terminal formed at the first socket connector and connected to the circuit pattern.

2. The power supplying module of claim 1, wherein the PCB further comprises a second socket connector, at least one corner of the second socket connector has a chamfered edge connecting two edges extending in different directions, and the first and second socket connectors are respectively disposed at opposite end portions of the side of the PCB.

3. The power supplying module of claim 2, wherein each of the first and second socket connectors comprises a first corner portion and a second corner portion adjacent to the first corner portion along the first direction, and each of the first and second corner portions of the first socket connector and each of the first and second corner portions of the second socket connector has a chamfered edge connecting two edges extending in different directions.

4. The power supplying module of claim 2, wherein the PCB further comprises a plurality of third socket connectors disposed between the first and second socket connectors and protruded toward the second direction, and each of leading corner portions of the third socket connectors has a rounded portion having a predetermined curvature.

5. The power supplying module of claim 1, wherein the PCB further comprises:

a plurality of other socket connectors disposed in a line along the first direction and protruded toward the second direction; and a plurality of dummy protrusions disposed between the other socket connectors, spaced apart from each other along the first direction, and protruded toward the second direction.

6. The power supplying module of claim 1, wherein the PCB further includes a guide groove having a first opening and a second opening, the second opening being positioned adjacent to the first opening in a direction opposite to the second direction, the first opening has a first width in the first direction, the second opening has a second width in the second direction, and the first width is larger than the second width.

7. A backlight assembly comprising:

a plurality of lamps disposed along a first direction;

a plurality of lamp sockets respectively connected to the lamps; and a power supplying module comprising a printed circuit board (PCB), the PCB comprising first and second socket connectors protruded from a side toward a second direction and respectively disposed at opposing end portions of the side of the PCB, the side extending along a first direction different from the second direction, each of the first and second socket connectors having at least one chamfered edge connecting two edges extending in respective first and second directions.

8. The backlight assembly of claim 7, wherein the PCB further comprises a plurality of third socket connectors disposed between the first and second socket connectors and protruded toward the second direction, and leading corner portions of the third socket connectors having a rounded portion having a predetermined curvature.

9. The backlight assembly of claim 7, wherein the PCB further comprises:

a plurality of third socket connectors disposed between the first and second socket connectors and protruded toward the second direction; and a dummy protrusion disposed at a side of at least one of the first, second and third socket connectors, spaced apart from the socket connectors, and protruded toward the second direction.

10. The backlight assembly of claim 7, wherein the PCB further comprises a guide groove having a first opening and a second opening, the second opening being positioned adjacent to the first opening in a direction opposite to the second direction, the first opening has a first opening width in the first direction, the second opening has a second opening width in the second direction, and the first opening width is larger than the second opening width.

11. The backlight assembly of claim 10, further comprising:

a receiving container having a bottom plate and forming a receiving space in which the lamps are received, and a guide protrusion protruding from the bottom plate toward an outside of the bottom plate.

12. The backlight assembly of claim 11, wherein the guide protrusion comprises:

an insert potion extending from the bottom plate, and the having a first width in the first direction; and a fixing portion disposed on the insert potion, and having a second width in the first direction, the second width being larger than the first width and the second opening width.

13. The backlight assembly of claim 12, wherein the insert potion is disposed in the second opening of the guide groove when the PCB is combined with the lamp sockets, and wherein at least part of the PCB is disposed between the fixing portion and the bottom plate.

14. A backlight assembly comprising:

a plurality of lamps;

a printed circuit board (PCB) having a straight edge and output terminals, the output terminals being disposed at the straight edge, and along an arrangement direction of the lamps; and a plurality of lamp sockets respectively making contact with the output terminals to connect the lamps to the PCB, and each of lamp sockets comprising a socket housing having an L-shaped clip portion partially enclosing the straight edge of the PCB.

15. The backlight assembly of claim 14, wherein each of the lamp sockets further comprise a socket terminal portion comprising a lamp terminal making contact with a lamp and an input terminal connected to the lamp terminal and making contact with an output terminal, and the socket housing further comprises a body cover portion having an inner space in which the socket terminal portion is received, exposing the input terminal, and connected to the clip portion.

16. The backlight assembly of claim 15, wherein the clip portion comprises:

a connector having first and second end portions, the first end portion being connected to the body cover portion; and an input terminal receiver connected to the second end portion of the connector, facing the body cover portion, and receiving the input terminal.

17. A backlight assembly comprising:

a plurality of lamps arranged along a first direction;

a receiving container having a bottom plate and forming a receiving space in which the lamps are received, and a guide protrusion extending from the bottom plate toward an outside of the bottom plate;

a plurality of lamp sockets combined with the receiving container and respectively connected to the lamps, each of the lamp sockets comprising a substrate inserting portion protruded outside of the receiving container; and a power supplying module comprising a printed circuit board (PCB), the PCB comprising socket connectors and a guide groove in which the guide protrusion is inserted, the socket connectors being arranged along the first direction and being protruded toward a second direction different from the first direction to be inserted into the substrate inserting portion of each of the lamp sockets, wherein the guide groove comprises:

a first opening having a first opening width in the first direction; and a second opening positioned adjacent to the first opening in a direction opposite to the second direction, and having a second opening width in the first direction, the first opening width being larger than the second opening width.

18. The backlight assembly of claim 17, wherein the guide protrusion comprises:

an insert potion extending from the bottom plate, and the having a first width in the first direction; and a fixing portion extending from the insert potion, and having a second width in the first direction, the second width being larger than the first width and the second opening width.

19. The backlight assembly of claim 18, wherein the insert portion is disposed in the second opening of the guide groove and at least part of the PCB is disposed between the fixing portion and the bottom plate, when the PCB is combined with the lamp sockets.

* * * * *